US011298844B2

(12) United States Patent
Anjum et al.

(10) Patent No.: US 11,298,844 B2
(45) Date of Patent: Apr. 12, 2022

(54) MULTIFUNCTIONAL WET SHAVING RAZOR

(71) Applicants: Samar Anjum, Edmonton (CA); Navniit Ssharma, New-Delhi (IN); Sanandan Sudhir, Bopal (IN)

(72) Inventors: Samar Anjum, Edmonton (CA); Navniit Ssharma, New-Delhi (IN); Sanandan Sudhir, Bopal (IN)

( * ) Notice: Subject to any disclaimer, the term of this patent is extended or adjusted under 35 U.S.C. 154(b) by 173 days.

(21) Appl. No.: 16/606,687

(22) PCT Filed: May 28, 2018

(86) PCT No.: PCT/IB2018/053775

§ 371 (c)(1),
(2) Date: Oct. 18, 2019

(87) PCT Pub. No.: WO2018/220507

PCT Pub. Date: Dec. 6, 2018

(65) Prior Publication Data

US 2020/0130208 A1 Apr. 30, 2020

(30) Foreign Application Priority Data

May 27, 2017 (IN) ..... 201711018669
May 3, 2018 (IN) ..... 201811016807

(51) Int. Cl.
*B26B 21/52* (2006.01)
*B26B 19/04* (2006.01)
(Continued)

(52) U.S. Cl.
CPC ..... *B26B 21/521* (2013.01); *B26B 19/046* (2013.01); *B26B 19/048* (2013.01);
(Continued)

(58) Field of Classification Search
CPC ..... B26B 21/521; B26B 21/08; B26B 21/14; B26B 21/446; B26B 21/20; B26B 21/22;
(Continued)

(56) References Cited

U.S. PATENT DOCUMENTS 1,441,016 A * 1/1923 Matthews ..... B26B 21/24 30/50
2,048,419 A * 7/1936 Wolfe ..... B26B 21/20 30/49

(Continued)

OTHER PUBLICATIONS

International Search Report for PCT/IB2018/053775, dated Sep. 26, 2018, 2 pages.

*Primary Examiner* — Phong H Nguyen
(74) *Attorney, Agent, or Firm* — Abel Schillinger, LLP

(57) ABSTRACT

Aspects of the present disclosure relates to a multifunctional shaving razor that is a combination of different kind of razor blade holders, trimmer and dry shaving gel/after-shave lotion for providing a single device with all necessary grooming stuff and is easy to handle and cost efficient. The proposed multifunctional shaving razor 100 consists of triangular detachable blade holder adaptor 200, trimmer assembly 600 and shaving gel dispensing system 400 for providing multi-functionality of shaving, grooming and trimming in a single device. The proposed multifunctional shaving razor 100 can be used universally as it provides a complete solution of all shaving and grooming needs in a single device that is compact to carry from one place to another.

21 Claims, 35 Drawing Sheets

(51) Int. Cl.
*B26B 19/28* (2006.01)
*B26B 21/14* (2006.01)
*B26B 21/44* (2006.01)

(52) U.S. Cl.
CPC ..... *B26B 19/28* (2013.01); *B26B 21/14* (2013.01); *B26B 21/446* (2013.01)

(58) Field of Classification Search
CPC ..... B26B 21/28; B26B 21/30; B26B 21/40; B26B 21/4012; B26B 21/52; B26B 19/046; B26B 19/048; B26B 19/28
USPC ..... 30/527, 34.1, 43.4, 50, 526, 529, 530, 30/531, 532, 537, 538
See application file for complete search history.

(56) References Cited

U.S. PATENT DOCUMENTS

| | | | | |
|---|---|---|---|---|
| 2,902,758 | A * | 9/1959 | Pressman | B26B 21/20 30/60.5 |
| 2003/0217468 | A1* | 11/2003 | Izumi | B26B 19/102 30/43.92 |
| 2009/0013534 | A1* | 1/2009 | Mallaridas | B26B 21/40 30/41 |
| 2011/0203124 | A1* | 8/2011 | Bridges | B26B 21/4037 30/539 |
| 2015/0239138 | A1* | 8/2015 | Kurzet | B26B 21/446 30/41 |
| 2016/0052153 | A1 | 2/2016 | Oosterhoff et al. | |
| 2016/0250764 | A1 | 9/2016 | Hashimoto | |
| 2017/0144317 | A1 | 5/2017 | Shimizu | |

* cited by examiner

MULTIFUNCTIONAL WET SHAVING RAZOR

TECHNICAL FIELD

The present disclosures relate to the field of shaving razors. In particular, the present disclosure pertains to a multifunctional shaving razor that enables use of different kinds of razorblades, and in addition provides additional grooming accessories.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

In the present, shaving razors are well developed and they very well satisfy majority of personal grooming needs. However, there are certain problems associated with shaving razors. For instance, those travelling from one place to another have to carry a range of personal grooming accessories (for e.g. shaving razor, trimmer, wet shaving gel etc.) to meet their requirement. Handling and managing multitude of grooming accessories can be a major problem, especially for those who travel for frequently.

Further, modern razors are designed in a way that they can only accommodate a corresponding kind of disposable blade cartridge (for e.g. Gillette Mach 3 razor can only accommodate its Mach 3 blade cartridge), and this can be a major problem for frequent travelers. In case of emergency during travel, a traveler would need to buy another razor, if blade cartridge that he uses is not available at the place of travel.

United States Patent Application US 2007/0017097 A1 discloses a combination of razor and dispenser for dispensing shaving cream wherein the razor has a tubular handle in which a pressurized dispensing container is mounted to dispense shaving cream. The pressurized dispensing container has a dispensing valve in communication with a dispensing opening of the handle, wherein application of an axial force at base of the container engages the dispensing valve with a surface of the handle to force the dispensing valve into a dispensing state, whereby product is dispensed through the dispensing valve and the dispensing opening.

WIPO Patent Application WO 2009\067176 A2 discloses a disposable safety razor integrated with a dispenser for dispensing shaving cream wherein the disposable safety razor includes a neck, a blade cartridge affixed to a top end of neck, a handle affixed to and extending from a bottom end of neck, a valve received in opening at bottom of the neck configured to dispense shaving cream downwardly through the valve and a dispensing cap covering the valve and engaged therewith such that movement of said dispensing cap causes release of shaving cream through the valve.

Patent Application number BE1000923 discloses a manual safety razor that consists of a handle, which has at its top end a support for holding a razor head, which contains several blades. The razor head is pivotally mounted in the support in a perpendicular direction. The blade support consists of a wheel with three arms set at 120 degrees to each other, and to the three arm are attached the blades with their cutting edges facing radially outwards. The blades are located in position by lugs and clamped by three domed, wedge-shaped covers, which clip to the arms by clamping elements. On either side of the side faces of the covers, are recesses into which projections on the inside faces of the support can be engaged. This enables the head to be locked in three different positions, enabling one of the blades to be brought into a working position. However, the razor head of the referred patent application is not amenable to hold blade cartridges, which are more commonly used now.

Evidently, combination of razors and dispensers for dispensing shaving gel/after-shave lotion as disclosed in references above can only be used for specific blade cartridge and there is no extra space or compartment for accommodating a trimmer. Hence, a person using the razors disclosed in above references, must take specific grooming stuff such as trimmer along with such razor while travelling.

There is, therefore, a need of a specific multifunctional shaving razor that accommodates more than one kind of blade cartridge in a single handle and includes a space or compartment in its body for other grooming stuff like trimmer and dry shaving gel/after-shave lotion such that it can be used universally.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from a group for reasons of convenience and/or patentability. When any such inclusion or deletion occurs, the specification is herein deemed to contain the group as modified thus fulfilling the written description of all groups used in the appended claims.

OBJECTS OF THE INVENTION

It is a general object of the present disclosure to provide a universal shaving razor that accommodates more than one kind of blade cartridge.

It is another object of the present disclosure to provide a universal shaving razor that accommodates additional grooming accessories such as shaving gel dispenser, after shave lotion dispenser and trimmer in its body.

It is yet another object of the present disclosure to provide a single wet shaving razor that can be used for shaving as well as trimming.

It is still another object of the present disclosure to provide a compact and low cost multifunctional wet shaving razor.

SUMMARY

Aspects of the present disclosure relate to a multifunctional wet razor that can hold blade cartridges of different types, enabling user to use a blade cartridge of his choice without having to change the razor. In an aspect, the disclosed multifunctional razor further included one or more grooming accessories such as a trimmer, a shaving gel dispenser and an after-shave lotion dispenser. Thus the present disclosure provides a single shaving razor that can use different types of shaving blade cartridges, and in addition provides other grooming accessories, thereby providing an easy to handle and economical and compact grooming accessory that occupies less space and is easy to carry.

In an aspect, the proposed multifunctional razor can comprise: a razor body having a top enclosure and a bottom enclosure; and a triangular shaped blade holder adaptor that is detachably attached to the top enclosure. Three sides of the triangular shaped blade holder adaptor defines three blade holder portions, wherein each of the three blade holder portions can be adapted to hold a different kind of blade cartridge.

In an embodiment, the three blade holder portions can include a first blade holder portion that is adapted to hold and eject a shaving blade cartridge that is held and locked by a plastic snap; a second blade holder portion that is adapted to hold and eject a shaving blade cartridge that is held and locked by clips and support collar, and a third blade holder portion that is adapted to hold and eject a shaving blade cartridge that is held and locked by leaf spring, plunger and pusher arms.

In an aspect, the present disclosure also provides different kinds of attachment means for detachably attaching the blade holder adaptor to the top enclosure that enable the blade holder adaptor to be fitted on the top enclosure with any one of the three blade holder portions in position of use.

In an embodiment of the attachment means, the attachment means can comprise: a set of three pins in equilateral triangle configuration, provided on the blade holder adaptor, in symmetry with the three portions of the blade holder adaptor, and a pair of two parallel grooves provided on the top enclosure, for example a front groove and a rear groove. In an application, when the blade holder adaptor is to be attached with the top enclosure with a desired blade holder portion in position of use, two of the three pins that are nearer to the desired blade holder portion of the blade holder adaptor can be engaged with the front groove, and the third pin can be engaged with the rear groove.

In an alternate embodiment of the attachment means, the attachment means can comprise; three equispaced snaps arranged in circular configuration on back side of the blade holder adaptor, and a circular cutout provided in a top cover of the multifunctional razor. Lower side of the circular cutout can incorporate a snap locking hollow boss, which incorporates three equispaced snap resting faces for resting the three equispaced snaps. Each of the three snap resting faces can be flanked by a flanking side face to prevent rotational movement of the blade holder adaptor. The attachment means can further include a spring configured between the top cover and the blade holder adapter to bias the snaps against the respective snap resting faces so that there is no play between the two and the blade holder adaptor is held firmly. In application, when a different blade holder portion is to be used, the blade holder adaptor can be pushed down against the biasing force of the spring to move the snaps beyond the respective flanking side faces, and thereafter, the blade holder adaptor can be rotated till the desired blade holder portion is in position of use. Thereafter the blade holder adaptor can be released for the snaps to take seat against the snap resting faces.

In an aspect, the bottom enclosure can be adapted to hold a shaving gel dispenser. The shaving gel dispenser can comprises: a gel container having a threaded top side, and adapted to be housed within the top enclosure such that the threaded top side of the gel container projects out of the top enclosure; a gel dispensing cap guided inside the bottom enclosure and adapted to move linearly against biasing force of a spring; and a gel dispensing pump fitted between the gel dispensing cap and the threaded top side from inner side of the threaded top side. The threaded top side of the gel container can be fitted in an internal threads of the bottom enclosure, and the bottom enclosure can thereafter be fitted to the top enclosure with the gel container inserted within the top enclosure.

In an aspect, the present disclosure also discloses a single blade ejection system configured within the blade holder adaptor that simultaneously unlocks and releases/ejects respective blade cartridges held in any of the three blade holder portions, with a single action. The disclosed blade ejection system can comprise: a cam; a first blade lock and a second blade lock, each pivotally fixed for pivotal movement through a respective hinge pin hole. The respective hinge pin holes divide the first blade lock and a second blade lock between a front side portion and a rear side portion. The rear side portions incorporate a follower face, and the front side portions incorporate a first blade locking lip adapted to hold a blade cartridge of first type in the first blade holder portion.

In an aspect, the first blade lock and the second blade lock are biased such that the respective follower face is in contact with the cam, and when the cam is moved, the first blade locking lips of the first blade lock, and the second blade lock of the second blade lock move inwards to release the blade cartridge held in the third blade holder portion.

In an aspect, the rear side portion of the first blade lock is adapted to, when the cam is moved, push a blade locking snap to eject a blade cartridge held in the first blade holder portion.

In an aspect, the rear side portion of the second blade lock is adapted to, when the cam is moved, push a pusher arm to eject a blade cartridge held in the second blade holder portion.

In an aspect, a flat metal spring can be provided to push the front side portions of the first blade lock and the second blade lock so as to bias the first blade lock and the second blade lock for the respective follower faces to remain in contact with the cam.

In an aspect, the blade holder adaptor comprises a top lid and a bottom lid, and wherein the blade ejection system is accommodated between the top lid and the bottom lid, with the cam adapted to move linearly along a slider button guide in the top lid. A slider button is provided to push the cam in linear direction for ejecting the blade cartridges.

In an alternate embodiment, the cam can be a rotary cam connected to a triangular rotating knob provided on the top lid. Rotating the triangular rotating knob can result in ejection of the blade cartridges.

In yet another aspect, the present disclosure provides a multifunctional razor that, besides having the triangular shaped blade holder adapt or having different blade holder portions, each capable of holding hold a different kind of blade cartridge, also includes a trimmer assembly along with its power source. The trimmer assembly and the power source can be housed between the top cover and the bottom cover and trimmer blades of the trimmer assembly can be located on a front side of the razor body being exposed through a window in an outer enclosure that fits the top cover and the bottom cover.

In an aspect, the trimmer assembly can comprise; an electric motor to drive an eccentric shaft, an eccentric follower driven by the eccentric shaft to undergo reciprocating rotary motion; a motion transfer link to transfer the reciprocating rotary motion of the eccentric follower to a first trimmer blade. The reciprocating motion of the first trimmer blade in relation with a fixed second trimmer blade provides cutting action to trim hair.

In an embodiment, the multifunctional razor with the trimmer assembly can further comprise a front cover to cover the exposed trimmer blades of the trimmer assembly.

BRIEF DESCRIPTION OF THE DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure.

DETAILED DESCRIPTION

Figure 1:
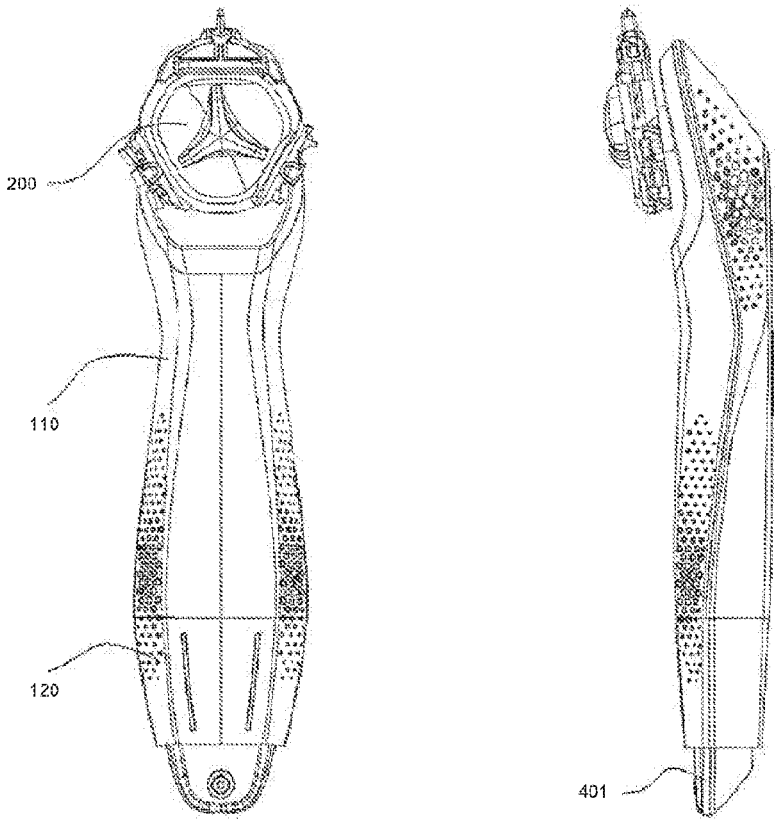
FIG. 1 illustrates exemplary top and side views of proposed wet shaving razor, in accordance with embodiments of the present disclosure.

In the following detailed description of exemplary embodiments of the invention, reference is made to the accompanying drawings that form a part hereof and, which show by way of illustration, specific exemplary embodiments in which the invent ion maybe practiced. These embodiments are described in sufficient detail to enable those skilled in the art to practice the invention. It is to be understood that other embodiments may be utilized, and that logical, mechanical, electrical and other changes may be made without departing from the spirit or scope of the present invention. The following detailed description is, therefore, not to be taken in a limiting sense, and the scope of the present invention is defined only by the appended claims.

the specification states a component or feature "may", "can", "could", or "might" be included or have a characteristic, that particular component or feature is not required to be included or have the characteristic.

Exemplary embodiments will now be described more fully hereinafter with reference to the accompanying drawings, in which exemplary embodiments are shown. This disclosure may, however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Various aspects of the embodiments described above may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Various terms as used herein are shown below. To the extent a term used in a claim is not defined below, it should be given the broadest definition persons in the pertinent art have given that term as reflected in printed publications and issued patents at the time of filing.

Embodiments explained herein relate to a multifunctional wet shaving razor that is a combination of one or more of different kinds of razor blade holders, trimmer, dry shaving gel dispenser and after-shave lotion dispenser, thus the present disclosure provides a single shaving razor that can use different types of shaving blade cartridges, and in addition provides other grooming accessories, thereby providing an easy to handle and economical and compact grooming accessory that occupies less space and is easy to carry.

In an aspect, the present disclosure provides a multifunctional wet shaving razor that incorporates a blade holder adaptor having more than one face for accommodating more than one kind of shaving blade cartridge, thus enabling use of more than one type of shaving blade cartridge. In another aspect, the proposed multifunctional wet shaving razor can also accommodate a trimmer assembly or a shaving gel dispensing system or an aftershave lotion dispensing system.

It is to be appreciated that though various embodiments of the present disclosure have been described with reference to a triangular shaped blade holder adaptor capable of holding three different types of blade cartridges, using the inventive concept of the present disclosure it is possible to have a blade holder adaptor of other shapes such as a polygon shape that can hold more than three cartridges, i.e. equal to number of sides of the polygon shape of the blade holder adaptor, and all such variations are well within the scope of the present disclosure.

In an embodiment, the proposed blade holder adaptor is a triangular blade holder adaptor with three faces, which includes a top lid and a bottom lid, each face having matching contours for a different kind of shaving blade cartridge to enable holding of the different types of blade cartridges.

In an aspect, a first blade holder portion of the triangular blade holder adaptor can hold and eject a shaving blade cartridge that is held and locked by a plastic snap, and a second blade holder portion of triangular blade holder adaptor can hold and eject a shaving blade cartridge that is held and locked by clips and support collar. In an aspect, a third blade holder portion of triangular blade holder adaptor can hold and eject a shaving blade cartridge that is held and locked by leaf spring, plunger and pusher arms.

In an aspect, blade holder adaptor includes an ejection system for detaching and attaching the blade cartridges. In another aspect, a common ejection system works to eject a blade cartridge irrespective of blade holder portion/face where the blade cartridge is held or to be held. Thus, the common ejection system simultaneously acts on all the three blade holder portions/faces.

In an aspect, the proposed multifunctional wet shaving razor comprises a top enclosure and a bottom enclosure, and the blade holder adaptor is part of the top holder, whereas the bottom holder can accommodate the trimmer assembly or the gel dispenser along with gel container, or the after-shave lotion dispenser. The trimmer assembly moves inwards and outwards of the bottom enclosure on guides and locks in position.

FIG. 1 illustrates exemplary top and side views of the proposed wet shaving razor 100, wherein the wet shaving razor 100 includes a top enclosure 110 and a bottom enclosure 120. The top enclosure 110 and the bottom enclosure 120 together defining a body that functions as a razor handle. The top enclosure 100 consists of a triangular blade holder adaptor 200, and the bottom enclosure 120 can house a gel container coupled to a gel dispensing cap 401. In alternate embodiment, the bottom enclosure 120 can house a trimmer (not shown in FIG. 1).

In an aspect, triangular blade holder adaptor 200 is fixed on outer side of the top enclosure 110, whereas gel container 402 and gel dispensing cap 401, or the trimmer assembly with its power source, as the case may be, are fixed in inner side of the bottom enclosure 120.

Figure 2A:
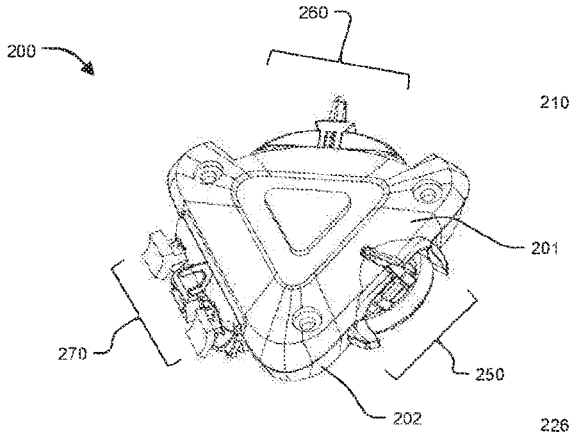
FIGS. 2A and 2B illustrate exemplary isometric and exploded views of blade holder adaptor in accordance with an embodiment of the present disclosure.
Figure 2B:
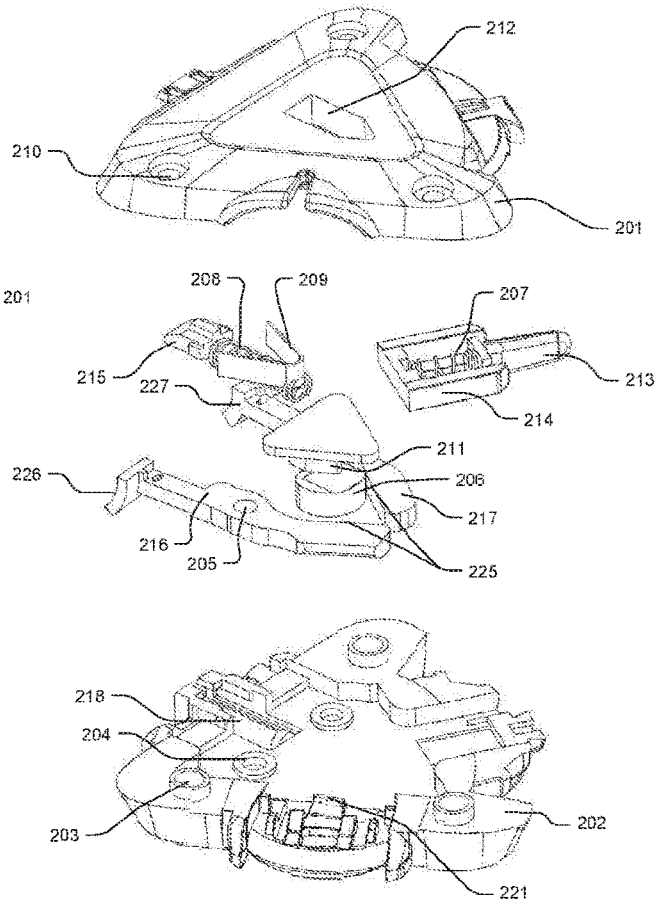

FIGS. 2A and 2B illustrate exemplary isometric and exploded views of the blade holder adaptor 200 in accordance with an exemplary embodiment of the present disclosure. In an aspect, triangular blade holder adaptor 200 as shown in FIG. 2A includes a top lid 201, a bottom lid 202, a first blade holder portion 250, a second blade holder portion 260 and a third blade holder portion 270 wherein both the top lid 201 and the bottom lid 202 are fixed together by three locking screws 210 (as shown in FIG. 2B).

In an aspect, three portions of triangular blade holder adaptor 200 are configured at 120 degree angle with respect to each other wherein three different kinds of blade holder arrangements are provided on the three portions of triangular blade adaptor 200 for accommodating three different kinds of blade cartridges as per requirements. About half of the first, the second and the third blade holder portions 250, 260 and 270 respectively are accommodated in top lid 201 and remaining are fixed in bottom lid 202. All other moving components which are used for locking, unlocking and ejecting blades are configured in between the top 201 and the bottom lid 202.

Referring to FIG. 2B where an exemplary exploded view of, the triangular blade holder adaptor 200 is shown, the triangular blade holder adaptor 200 can consist of a cam and follower mechanism consisting of a cam 206 and followers having follower faces 225 to operate blade ejection system for ejecting/holding blade cartridges held in any of the three portions 250, 260 or 270 of the blade holder adaptor 200. The follower faces 225 can be in continuous contact with the cam 206 being biased by a flat metal spring 209. A slider button 211 can be attached with the cam 206 for manually actuating the cam 206. The top lid 201 can include a slider button guide 212 which helps the slider button 211 to slide in a constrained manner.

In an aspect, ejection mechanism at the first blade holder portion 250 can include a blade locking snap 221 which is controlled by a first blade lock 216. Ejection mechanism at the second blade holder portion 260 can include a second plunger 213, a second guide spring 207 and a pusher arm 214 wherein the pusher arm 214 stays in contact with a second blade lock 217 using second guide spring 207 and it is used to eject a blade which is fitted in second blade holder portion 260. Ejection mechanism at the third blade holder portion 270 includes a first blade lock 216, a second blade lock 217, a first plunger 215 and a first guide spring 208, wherein the first blade lock 216 includes a first blade locking lip 226, a hingepin hole 205 and the follower face 225. The second blade lock 217 can include a second blade locking lip 227, a hinge pin hole 220 and the follower face 225. The first blade lock 216 and the second blade lock 217 are fixed and pivoted through the respective hinge pins 220, as shown in FIG. 2D.

Figure 2C:
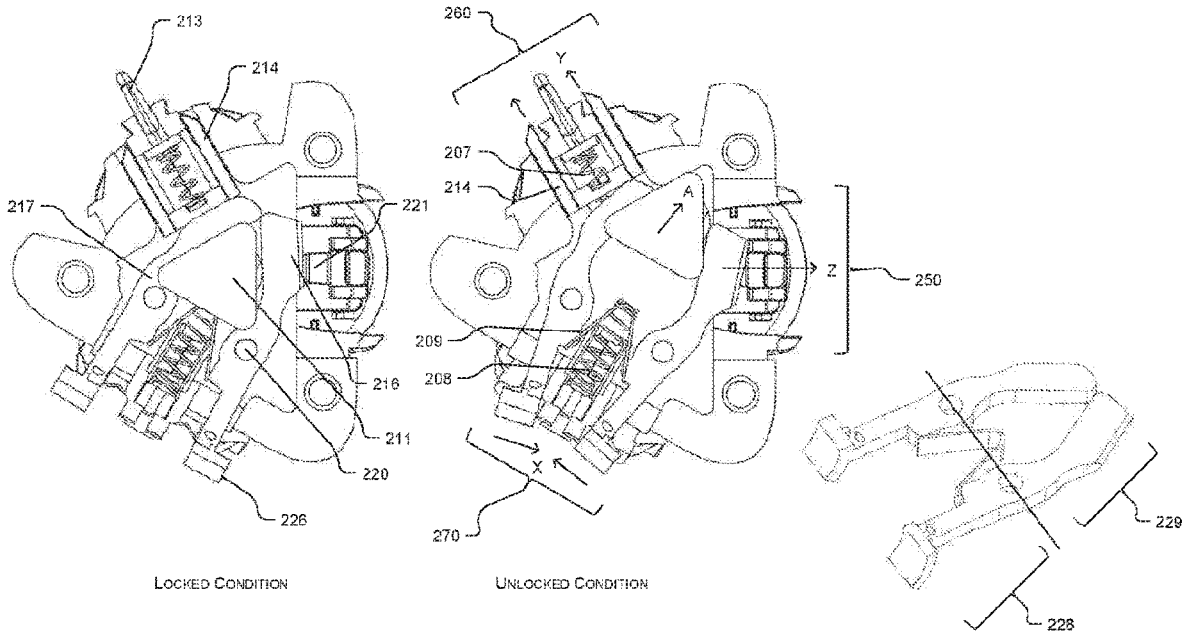
FIG. 2C illustrates an exemplary representation showing operation of the blade holder adaptor in accordance with an embodiment of the present disclosure.

FIG. 2C illustrates an exemplary representation showing operation of the blade holder adaptor 200 wherein ejection system of the blade holder adaptor 200 is arranged in such a way that all the three blades eject at same time. For unlocking blades, the slider button 211 can be pushed upward in "A" direction, on which the cam 206 moves the follower faces 225 in outward direction. The first blade lock 216 and the second blade lock 217 are hinged at pivot point (i.e. hinge pin hole 205) and both are continuously in contact with flat metal spring 209 from front side 228, which provides the biasing force to the first blade lock 216 and the second blade lock 217 to remain in contact with the cam 206. Further, as cam moves in "A" direction, rear side portions 229 (i.e. the sides that are in contact with the cam 206) of both the first blade lock 216 and the second blade lock 217 are moved in outward direction, and front side portion 228 (i.e. portion of the first blade lock 216 and the second blade lock 217 that lies on other side of the hinge pin hole 205), which locks a blade cartridge in the portion, moves inward defined as direction "X", due to which first blade locking lip 226 and second blade locking lip 227 (refer to FIG. 2B) release and unlock the blade cartridge which is fitted in third blade holder portion 270.

In an aspect, same as when slider moves in "A" direction, the rear side portion 229 of the first blade lock 216 pushes a blade locking snap 221 on lower side and ejects blade cartridge held in the first blade holder portion 270. Simultaneously the rear side portion 229 of the second blade lock 217 pushes a pusher arm 214 in "Y" direction, which ejects a blade cartridge that may be held in the second blade holder portion 260. During ejection of blade fitted in the second blade holder portion 260, cycle pusher arm 214 also push first guide spring 207. When force is removed from the slider button 211, the metal flat spring 209 moves the front portion 228 of the first blade lock 216 and the second blade lock 217 in outward direction and locks the blades.

Figure 2D:
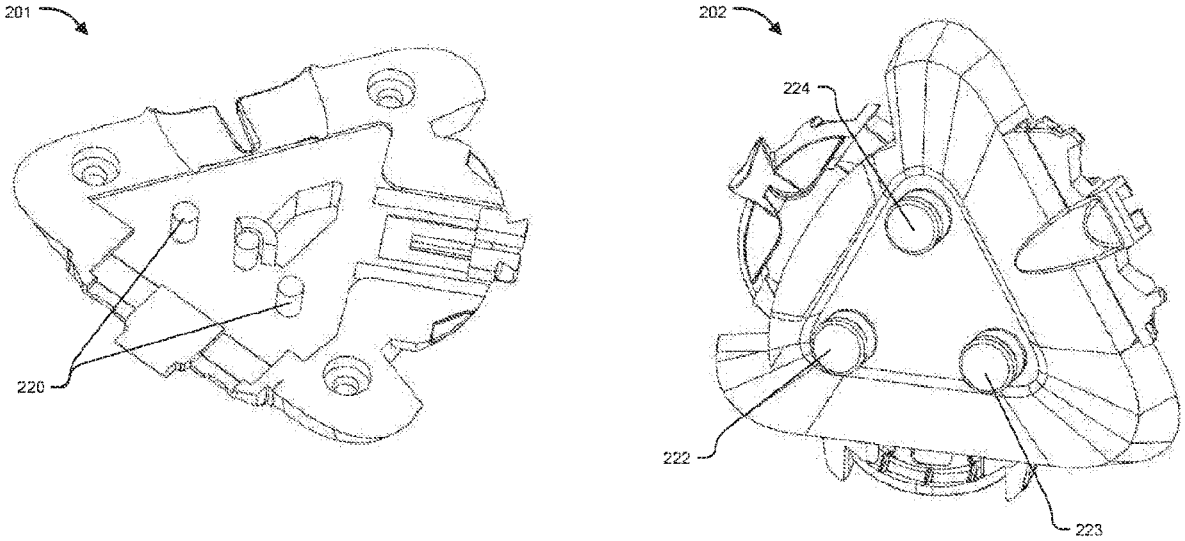
FIG. 2D illustrates an exemplary representation of blade holder adaptor lid, in accordance with an embodiment of the present disclosure.

Referring now to FIG. 2D, the top lid 201 of the blade holder adaptor 200 consists of at least two hinge pins 220, and the bottom lid 202 of the blade holder adaptor 200 consists of a first locking pin 222, a second locking pin 223 and a third locking pin 224. In an aspect, the first blade lock 216 and the second blade lock 217 are fixed and pivoted through the hinge pins 220. In an aspect, the locking pins 222, 223 and 224 of the bottom lid 202 are used to lock the triangular blade holder adaptor 200 to the top enclosure 110.

Figure 2E:
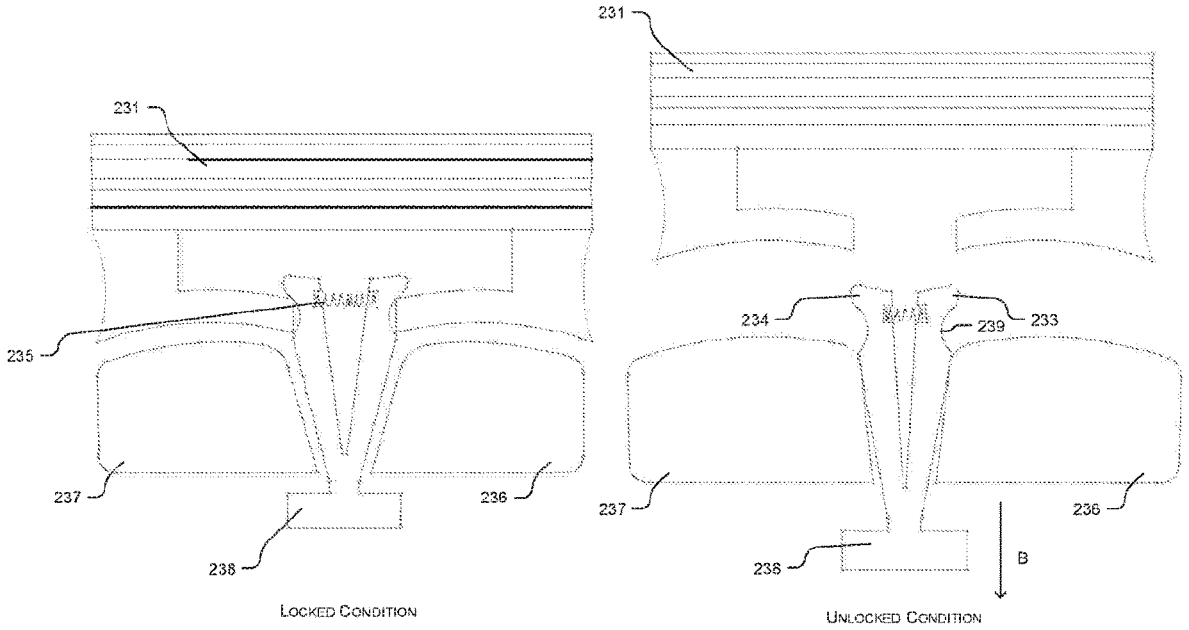
FIG. 2E illustrates an exemplary representation showing locked and unlocked condition of a blade in accordance with an embodiment of the present disclosure.

FIG. 2E illustrates exemplary representation of locked and unlocked condition of a blade in the second blade holder portion 260, wherein the blade ejection mechanism of the second blade holder portion 260 includes a first fix portion 236, a second fix portion 237 and flexible blade lock 238. The fix portions 236 and 237 are integral part of the triangular blade holder adaptor 200, wherein lower portion of flexible blade lock 238 is in contact with slider button 211 for ejecting blade that is fitted in the second blade holder portion 260. Flexible blade lock 238 consists of a first lock portion 233, a second lock portion 234 and blade locking groove 239. During blade locking condition, flexible blade lock 238 is in normal condition and shaving blade cartridge 231 is pressed on it, due to which flexible plastic part 232 is fixed in blade locking groove 239. Both first lock portion 233 and second lock portion 234 are forced outward due to spring 235.

In an aspect, for unlocking the shaving blade cartridge 231 from adaptor, slider button 211 is moves in "A" direction (as clearly described in FIG. 2C), due to which flexible blade lock 238 moves in downward "B" direction. As flexible blade lock 238 moves in downward direction, both first lock portion 233 and second lock portion 234 are guided into first fix portion 236 and second fix portion 237 respectively, and move in inward direction, due to which flexible plastic part 232 is released from blade locking groove 239, and the blade which is fitted in the second blade holder portion 260 is unlocked.

Figure 3:
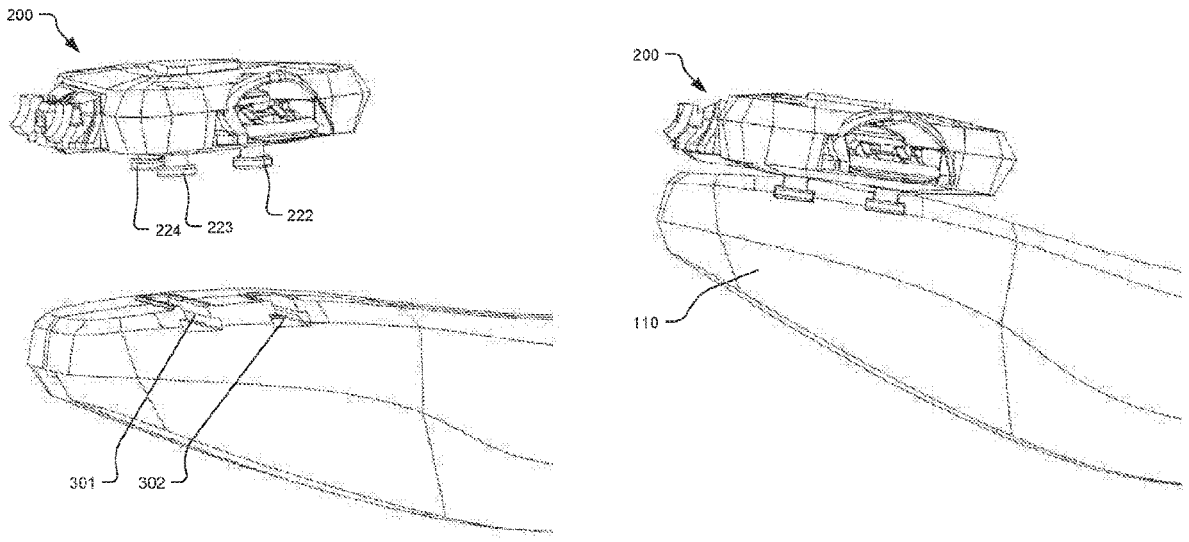
FIG. 3 illustrates an exemplary representation showing assembly of the blade holder adaptor and top enclosure in accordance with an embodiment of the present disclosure.

FIG. 3 illustrates exemplary representation of assembly of the blade holder adaptor 200 with the top enclosure 110 wherein the bottom lid 202 of the blade holder adaptor 200 can include a first locking pin 222, a second locking pin 223 and a third locking pin 224, which are used to lock the triangular blade holder adaptor 200 to the top enclosure 110. Top enclosure 110 includes two parallel grooves: a front locking groove 301 and a rear locking groove 302, for accommodating the locking pins 222, 223 and 224.

In an embodiment, as shown in the exemplary illustration, the front locking groove 301 and the rear locking groove 302 can be T shaped, with the pins 222, 223 and 224 also having a matching shape to ensure that the pins engage with the grooves firmly without any possibility of accidental separation.

In an aspect, if a user wants to use a blade, which is fitted in first blade holder portion 250, then he has to lock first locking pin 222 and second locking pin 223, which are nearer to the first blade holder portion 250, in the front groove 301, and the third locking pin 224 in the rear groove 302. In this configuration, a blade cartridge which is held in the first blade holder portion 250 shall be available at front end of the shaving razor 100 for use. Incase, if user wants to use blade which is fitted in the second blade holder portion 260, then he has to lock the first locking pin 222 and the third locking pin 224 in the front groove 301, and the second locking pin 223 in the rear groove 302, on which the blade which is fitted in the second blade holder portion 260 shall be available on front face of shaving razor 100 (not shown). Further, if user wants to use a blade which is fitted on the third blade holder portion 270, then he must lock the second locking pin 223 and the third locking pin 224 in the front groove 301 and the first locking pin 222 in the rear groove 302, on which the blade that is fitted in the third blade holder portion 270 shall become available on front face of shaving razor 100 (as shown herein).

In an application where the blade holder adapter is of square shape with four blade holder portions, there can be locking pins similar to locking pin 222, arranged in symmetry with the square shape of the blade holder adaptor, and when the square blade holder adaptor is to be attached with the top enclosure with a desired blade holder portion in position of use, two of the four locking pins that are nearer to the desired blade holder portion of the blade holder adaptor can be engaged with the front groove, and the remaining two pins can be engaged with the rear groove.

Figure 4:
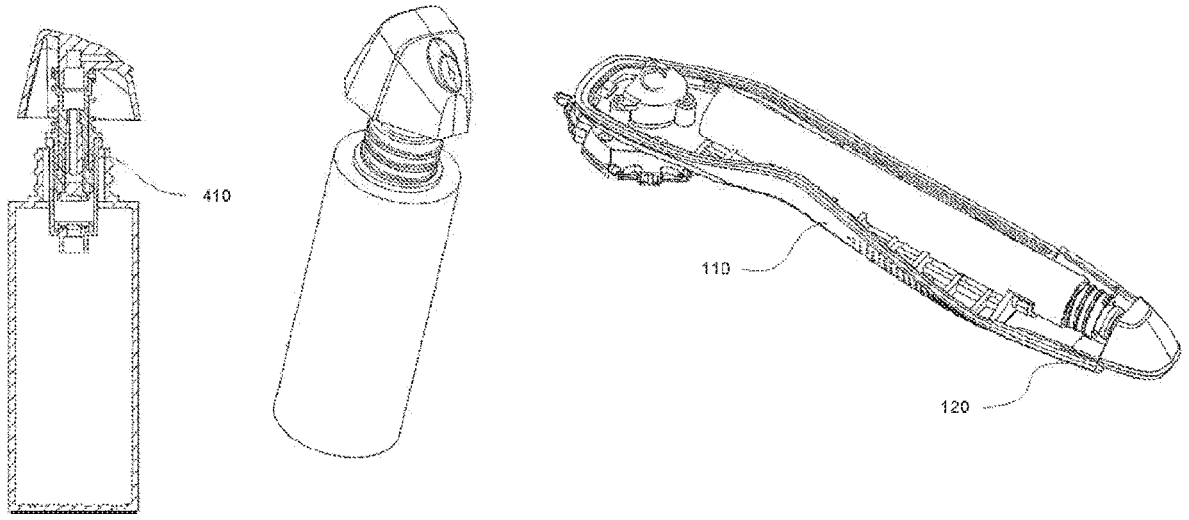
FIG. 4 illustrates an exemplary representation showing assembly of a shaving gel dispensing system in the proposed wet shaving razor, and its working, in accordance with an embodiment of the present disclosure.

FIG. 4 illustrates an exemplary representation of assembly and working of a shaving gel dispensing system 400 wherein shaving gel dispensing system 400 includes a gel dispensing cap 401, a gel container 402, a gel dispensing pump 410 and a dispenser spring 403. The gel container 402 includes a threaded top side 404 for locking the container 402 within the bottom enclosure 120. The gel dispensing cap 401 is guided inside the bottom enclosure 120 and actuates by action of dispenser spring 403. The gel dispensing pump is fitted between the gel dispensing cap and the threaded top side 404 from inner side of the threaded top side 404.

In an aspect, when user wants gel to be dispensed for shaving, he must press gel dispensing cap 401 in "W" direction. When the gel dispensing cap is pressed in "W" direction, the dispenser spring 403 gets compressed and the gel dispensing pump 410 works to dispense the gel form the gel container 402. Further, when the user releases dispensing cap 401, the gel dispensing cap 401 comes back to its original position due to tension of the dispenser spring 403.

Figure 5:
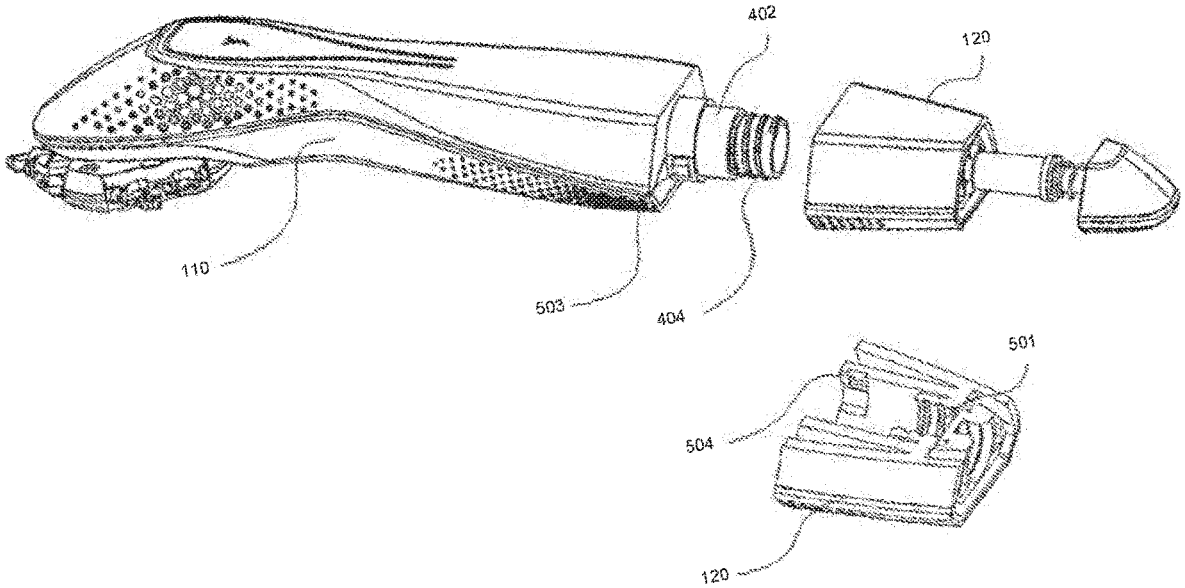
FIG. 5 illustrates an exemplary exploded view showing top enclosure and bottom enclosure, in accordance with an embodiment of the present disclosure.

FIG. 5 illustrates an exemplary representation of assembly of the top enclosure 110 and the bottom enclosure 120, wherein the bottom enclosure 120 consists of internal threads 501, a guide for the gel dispensing cap 502 and a male protrusion 503. The threaded top side 404 of the gel container 402 can befitted in the internal threads 501 of the bottom enclosure 120, and the male protrusion 503 fits the in female groove 504 which is provided on the bottom enclosure 120.

Figure 6A:
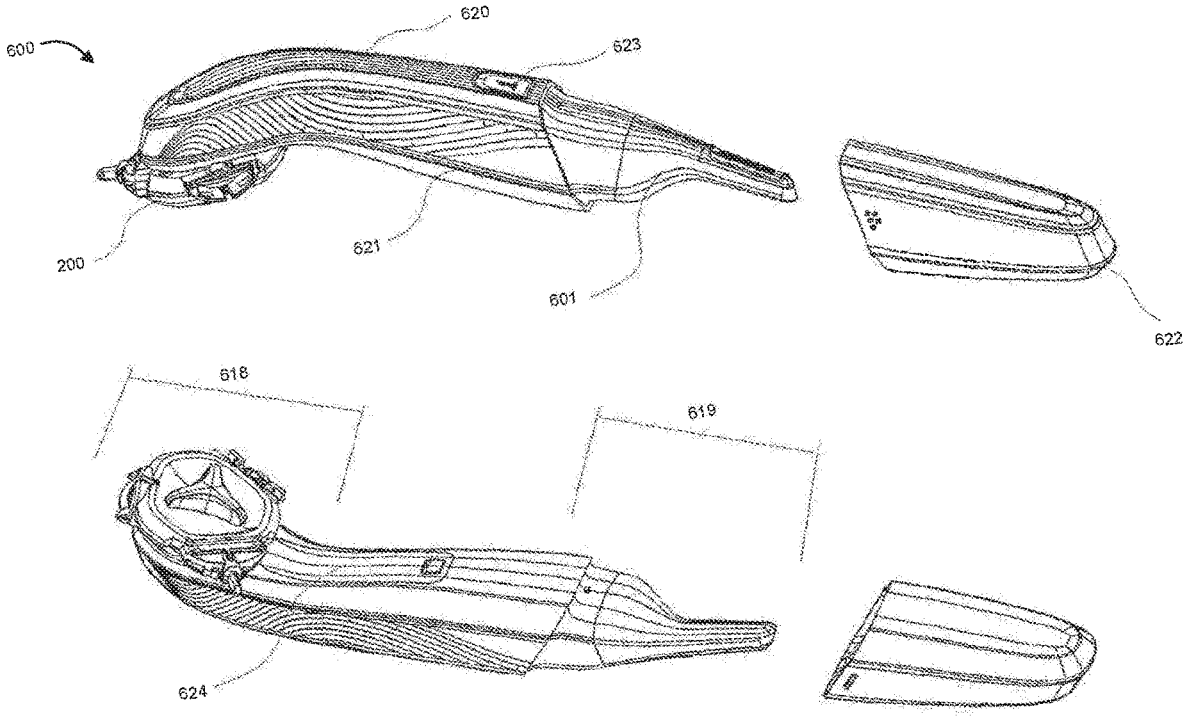
FIGS. 6A to 6D illustrate exemplary exploded view showing fitment of a trimmer assembly within the proposes wet shaving razor and functioning, in accordance with an embodiment of the present disclosure.

FIGS. 6A to 6D illustrate an exemplary embodiment through representative views of a trimmer assembly 600 housed within the bottom enclosure 120, wherein FIG. 6A describes the trimmer assembly 600 that consists of a top cover 620, a bottom cover 621, a front cover 622, a power switch cover 623, and a battery cover 624. The blade holder adaptor 200/800 (refer FIG. 8) is fitted on the back side 618 of the assembly, whereas the trimmer enclosure 601 is fitted on the front side 619 of the assembly 600.

Figure 6B:
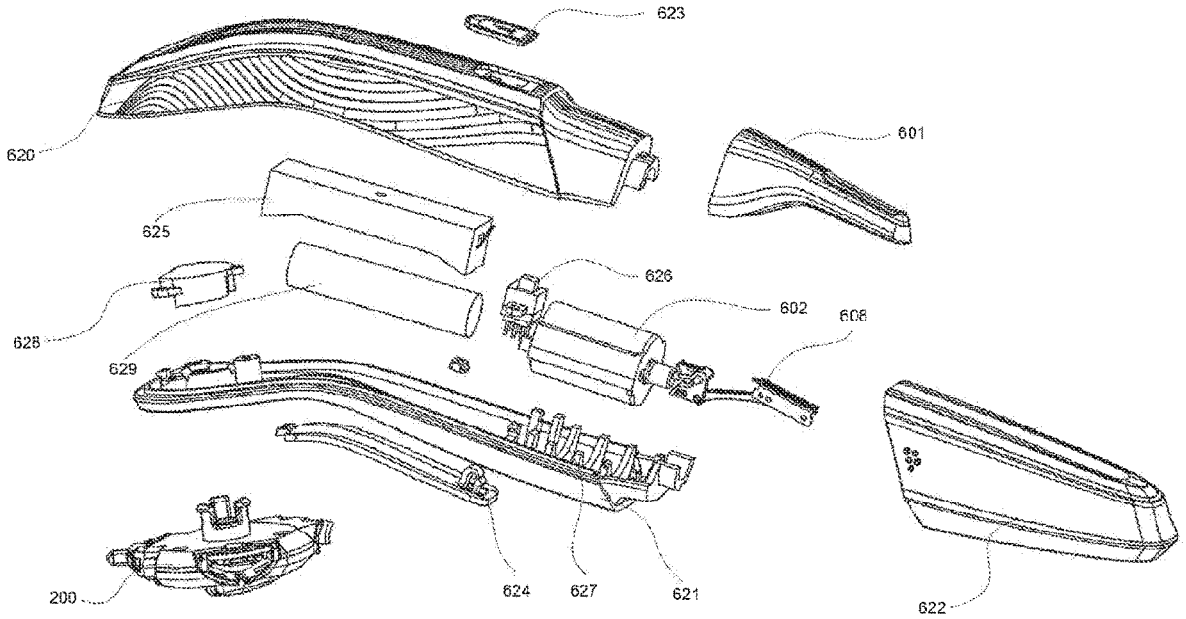

FIG. 6B illustrates an exemplary exploded view of trimmer and shaving system assembly wherein the bottom cover 621 incorporates a hollow portion on back side for accommodating a blade holder adaptor 200/800, and a cut out in center for battery cover 624, which provides access for battery replacement. The top cover 620 incorporates a cutout in center to accommodate the power switch cover 623. Top cover 620 and bottom cover 624 can befitted to each other by a plastic snap. The trimmer enclosure 601 is fitted to the main body by a snap, and accommodates the trimmer blade assembly. Power button 626 is fitted on a motor resting face 627 in bottom cover 621. Replaceable battery 629 can be fitted in the battery enclosure 625 inside the body and connected with the electric motor 602. Power button 626 is placed on the bottom cover 621, and connected with the power switch cover 623 for ease of operation from top side. The front cover 622 is provided to cover the trimmer enclosure 601 when the trimmer is not in use.

Figure 6C:
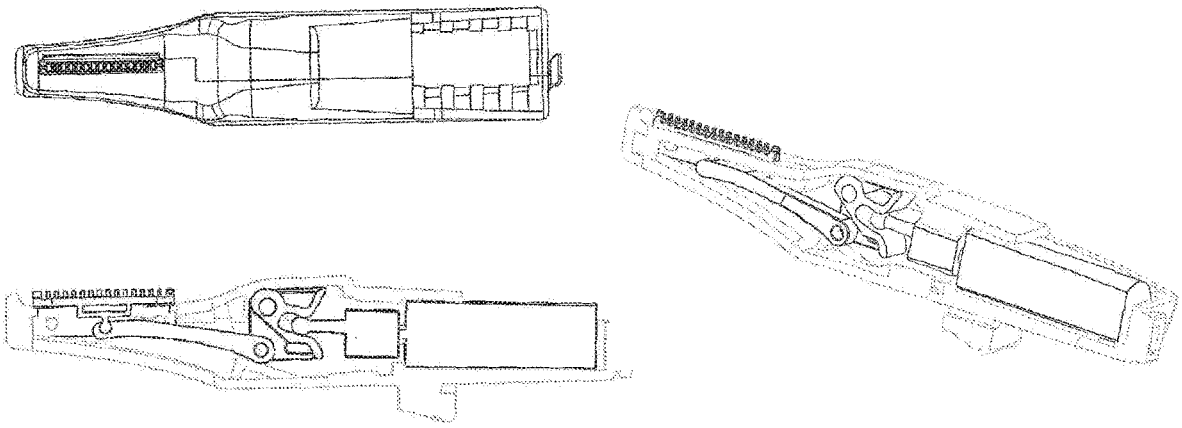

Referring to FIG. 6C, which shows constituent parts of the trimmer assembly 600, the trimmer assembly 600 can consist of an outer enclosure 601, an electric motor 602, a primary shaft 603, an eccentric shaft 604, an eccentric follower 605, a motion transfer link 606, a first trimmer blade 607 and a second trimmer blade 608.

In an aspect, the electric motor 602 is connected with power supply 130/629 by a connecting wire for getting input power. Output of electric motor 602 is a rotational motion of the primary shaft 603. The eccentric shaft 604 is fixed on the primary shaft 603. The eccentric follower 605 is fixed on pin (not shown) which is an integral part of the outer enclosure 601, and the eccentric follower 605 is free to rotate. The motion transfer link 606 is connected with the eccentric follower 605 and the first trimmer blade 607 by a cylindrical pin joint. The second trimmer blade 608 is fixed in the outer enclosure 601. The outer enclosure 601 is fixed in the top enclosure 110 of multifunctional shaving razor 100.

Figure 6D:
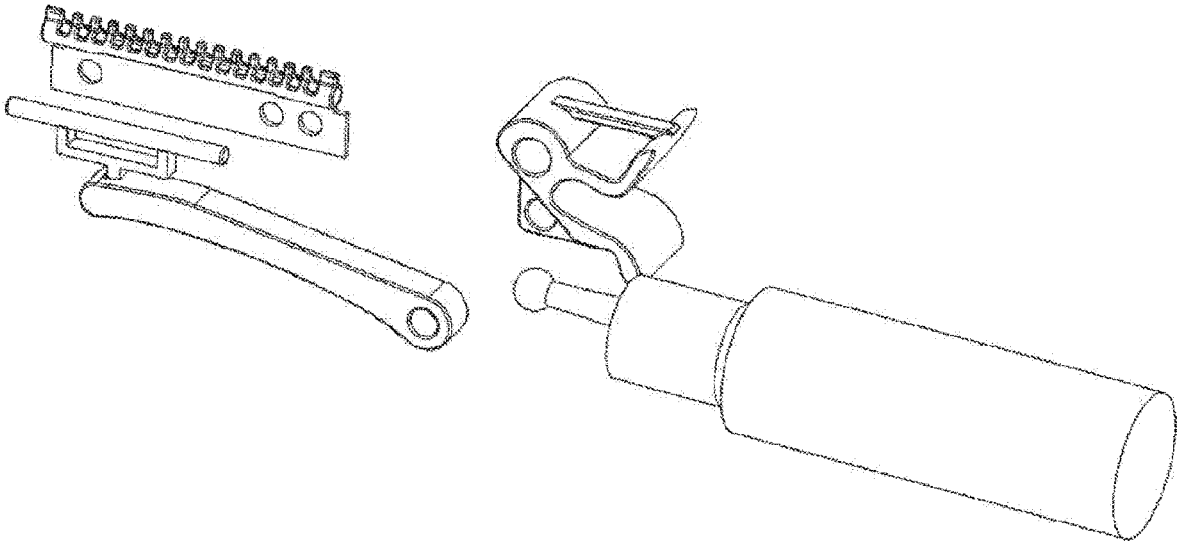

Referring now to FIG. 6D, as power supply is provided to the motor 602, the eccentric shaft 604 starts to rotate along "N" axis. The eccentric shaft 604 is directly in contact with the shaft contact face 612 of the eccentric follower 613. The eccentric follower 613 is pivotally fixed with a pin (not shown) through the pivot hole 610, and it oscillates along the "Z" Axis. The motion transfer link 606 is connected with the eccentric follower 613 through hinge pin hole 611. As Eccentric shaft 604 rotates eccentrically along "N" axis, it oscillates eccentric follower 605, due to which the motion transfer link 606 moves linearly in "X" direction and in turn reciprocates in the hollow portion 609 of the stationary second trimmer blade 608. Hair that come in between the trimmer cutting teeth 614 and the first trimmer blade 607 get cut due to relative reciprocating motion between the two.

Figure 7:
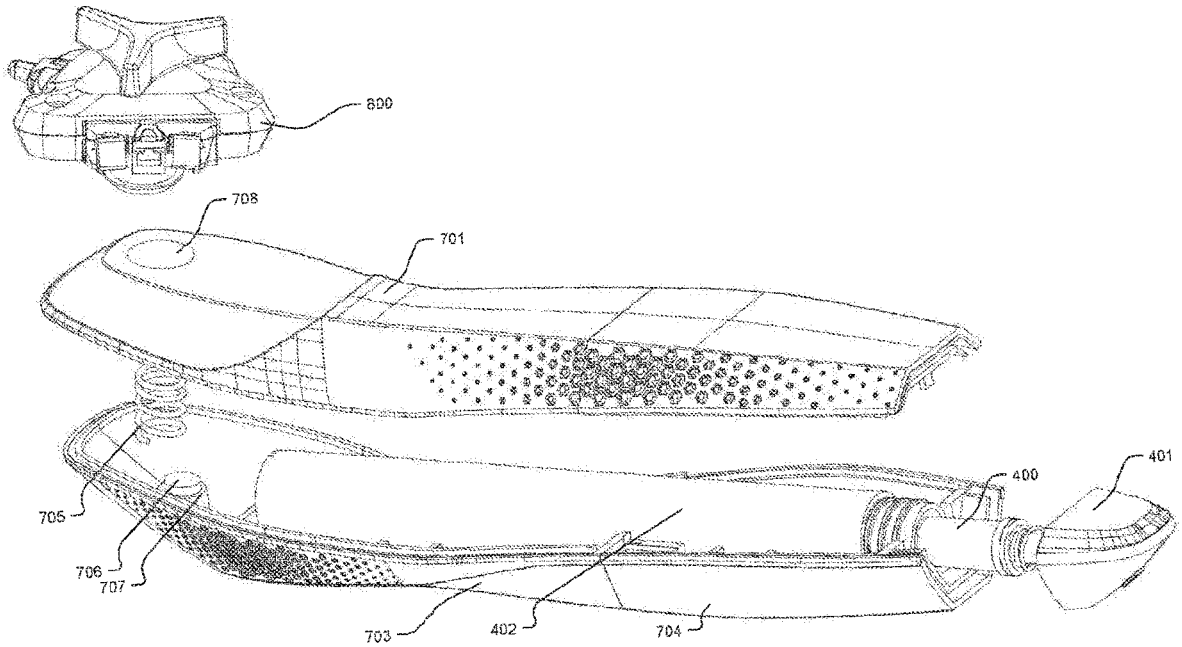
FIG. 7 illustrates an exemplary exploded view of wet shaving razor in accordance with embodiments of the present disclosure.

FIG. 7 illustrates an exemplary exploded view of another embodiment of the disclosed multifunctional wet shaving razor, wherein the wet shaving razor assembly consists of a blade holder adaptor 800, a top cover 701, a bottom cover 703, a blade holder spring 705, a gel dispensing system 400 and a gel dispensing cap 401.

In an aspect, blade holder adaptor 800 is fitted in the top cover 701 through a circular cut out 708 wherein one end of the blade holder spring 705 is rested on a spring resting face 707 and guided through a spring guide boss 706. Further, the blade holder spring 705 provides continuous upward biasing force to the blade holder adaptor 800 for keeping the blade holder adaptor 800 rigidly in its position.

Figure 8:
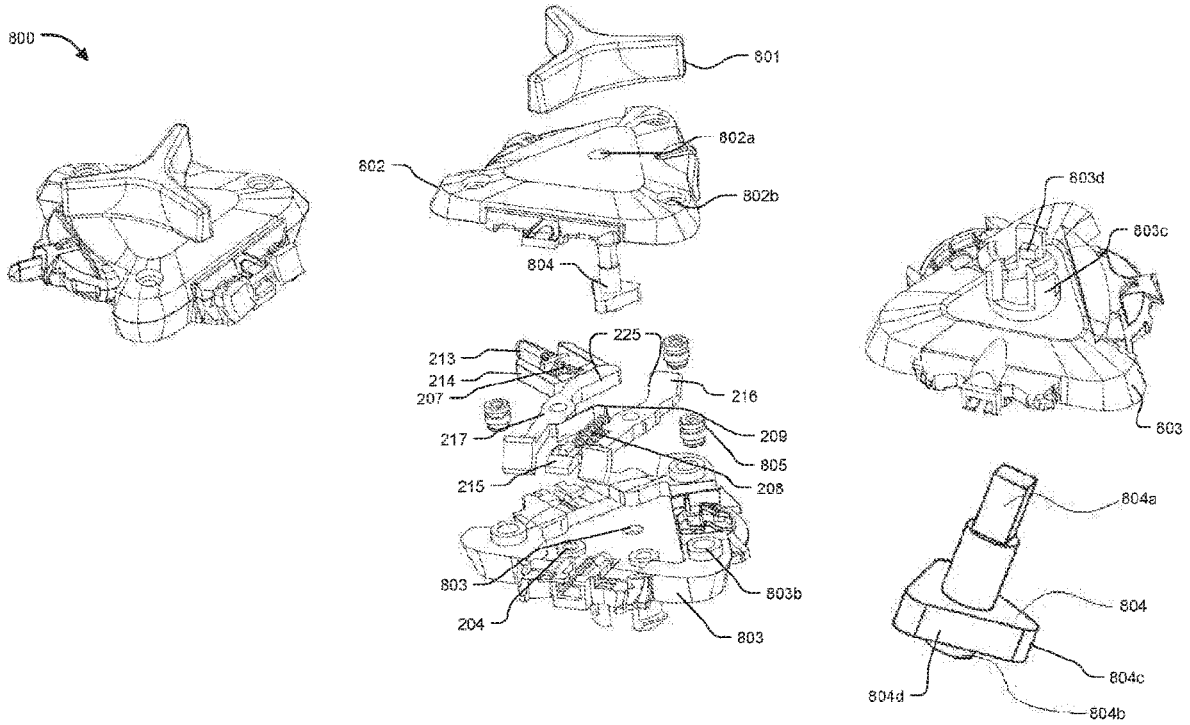
FIG. 8 illustrates an exemplary exploded view of a blade holder adaptor of the proposed wet shaving razor, in accordance with an embodiment of the present disclosure.

FIG. 8 illustrates exemplary isometric and exploded views of the blade holder adaptor 800, wherein the blade holder adaptor 800 includes a triangular rotating knob 801, a top lid 802, a bottom lid 803 and a triangular rotating cam 804, wherein the top lid 802 includes clearance hole 802*a* for providing a space for coupling of the triangular rotating cam 804 with the triangular rotating knob 801. Further, three screw resting recess 802 bare provided on outer side of the top lid 802 for accommodating screw heads.

In an aspect, the triangular rotating cam 804 has a square boss 804*a* on its top side, which is fitted in the triangular rotating knob 801; and a round boss 804*b* on bottom side, which is guided in a circular recess 803*a* for smooth rotation of the triangular rotating cam 804 when rotated manually by the triangular rotating knob 801. The bottom lid 803 includes three snaps 803*c* equispaced in circular positions on its bottom side, and are adapted to engage with the circular cutout 708 in the top cover 701 (refer FIG. 7) for fitment of the blade holder adaptor 800. The snaps 803*c* have a three-spring resting boss 803*d* on inner side to provide a flat surface for resting of the blade holder spring 705. The bottom lid 803 incorporates three hollow bosses 803*b* for accommodating three threaded inserts 805. The top lid 802 and the bottom lid 803 are fixed together by three screws (not shown in FIG. 8). Screws are fixed in the threaded inserts 805.

In an aspect, triangular blade holder adaptor 800 includes a triangular rotating cam 804 and follower mechanism to operate blade ejection system for three different kinds of blades, wherein follower faces 225 are continuously in contact with the triangular rotating cam 804 by a flat metal spring 209. The triangular rotating cam 804 is fixed with triangular rotating knob 801 through square boss 804*a* from topside and freely rotatable and guidable in circular recess 803*a* and it is operated by rotating the triangular rotating knob 801.

In an aspect, blade ejection mechanism at the first blade holder portion 250 includes a blade locking snap 221, which is controlled by the first blade lock 216. In an aspect, blade ejection mechanism at the second blade holder portion 260 includes a second plunger 213, second guide spring 207 and pusher arm 214, wherein the pusher arm 214 always stays in contact with the second blade lock 217 on account of the second guide spring 207, and it is used to eject a blade which is fitted in the second blade holder portion 260. In an aspect, blade ejection mechanism at the third blade holder portion 270 (as shown clearly in FIG. 9) consists of the first blade lock 216, second blade lock 217, first plunger 215 and first guide spring 208, wherein the first blade lock 216 includes first blade locking lip 226, hinge pinhole 205 and follower face 225, second blade lock 217 also includes second blade locking lip 227 (as shown clearly in FIG. 9), hinge pinhole and follower face 225. The first blade lock 216 and the second blade lock 217 are fixed and pivoted through hinge pins (not shown).

Figure 9:
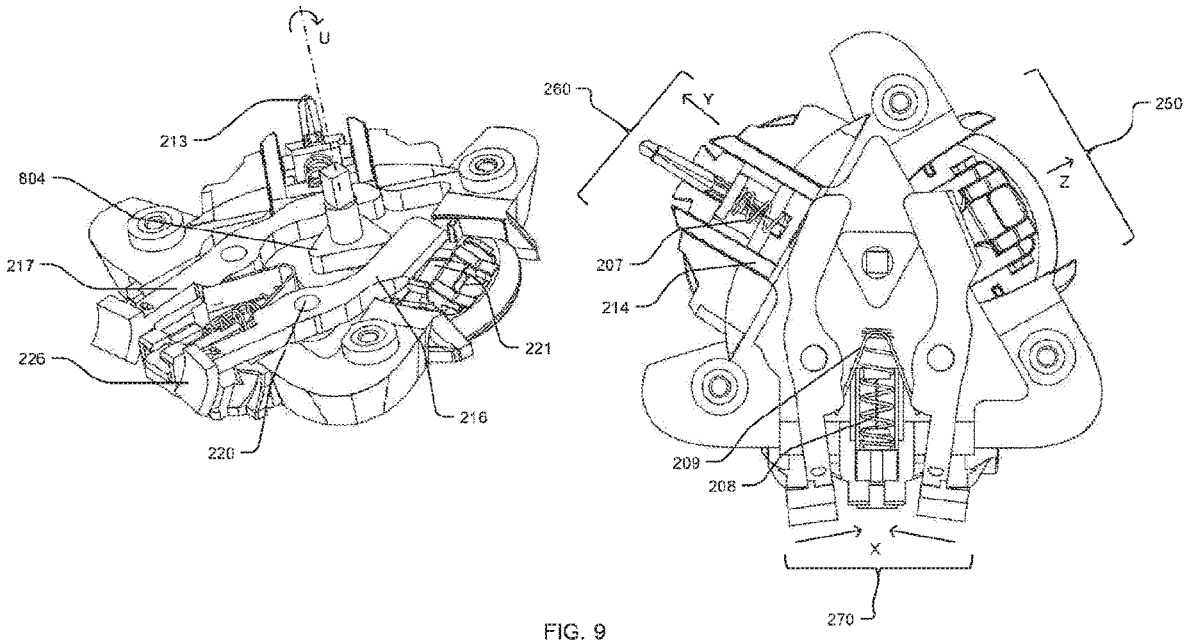
FIG. 9 illustrates an exemplary representation of blade locking and unlocking mechanism in the blade holder, in accordance with embodiments of the present disclosure.

FIG. 9 illustrates an exemplary representation of working of blade locking and unlocking system wherein blade locking and unlocking mechanism is arranged in such a way that the blades irrespective of position where it is fitted gets ejected by single action of the blade locking and unlocking system. For unlocking blades, triangular rotating knob 801 is rotated 60 degree in "U" direction due to which triangular rotating cam 804 also rotates, and triangular rotating cam 804 moves follower faces 225 outwards as its round corner 804*c* (as shown in FIG. 8) comes in contact with the follower faces 225. The first blade lock 216 and the second blade lock 217 are hinged at pivot point and both are continuously in contact with flat metal spring 209 from front side 228. As cam 804 (as shown clearly in FIG. 8) rotate in "U" direction, both rear side portions 229 (as shown in FIG. 2C) of the first blade lock 216 and the second blade lock 217 are moved outwards, and front side portion 228 (as shown in FIG. 2C), which lock the blade, move in inward direction defined as "X" direction, due to which the first blade locking lip 226 and the second blade locking lip 227 (as shown in FIG. 2B) release and unlock the blade which is held in the third blade holder portion 270.

In an aspect, when the rotary cam 804 rotates indirection "U", rear portion of the first blade lock 216 pushes the blade locking snap 221 in lower side to eject a blade which may be held in the first blade holder portion 250, simultaneously rear side portion 229 of the second blade lock 217 pushes the pusher arm 214 in "Y" direction, which ejects a blade which may be held in the second blade holder portion 260.

In an aspect, during ejection, the pusher arm 214 also pushes the first guide spring 207. When the triangular rotating knob 801 (shown in FIG. 8) rotates further by 60 degrees in "U" direction, the flat face 804*d* of the cam 804 (as shown in FIG. 8) allows the follower face 225 to move back under force of the metal flat spring 209, which results in the front portion 228 of first blade lock 216 and second blade lock 217 to move in outward direction and lock a blades.

Figure 10A:
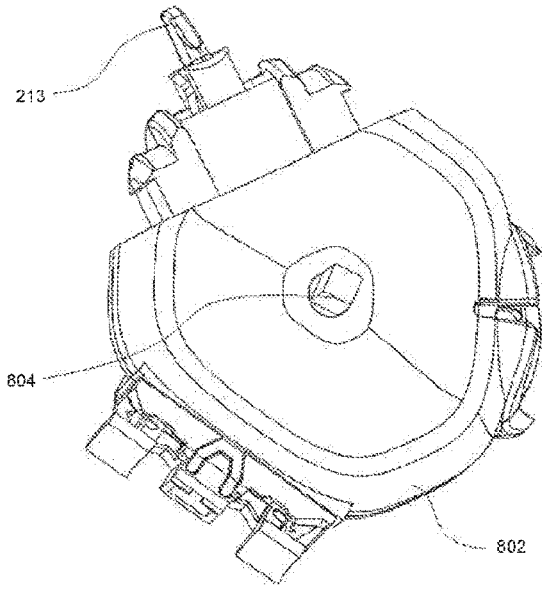
FIGS. 10A to 10D illustrate different exemplary views of a first triangular blade holder concept, in accordance with embodiments of the present disclosure.
Figure 10A:
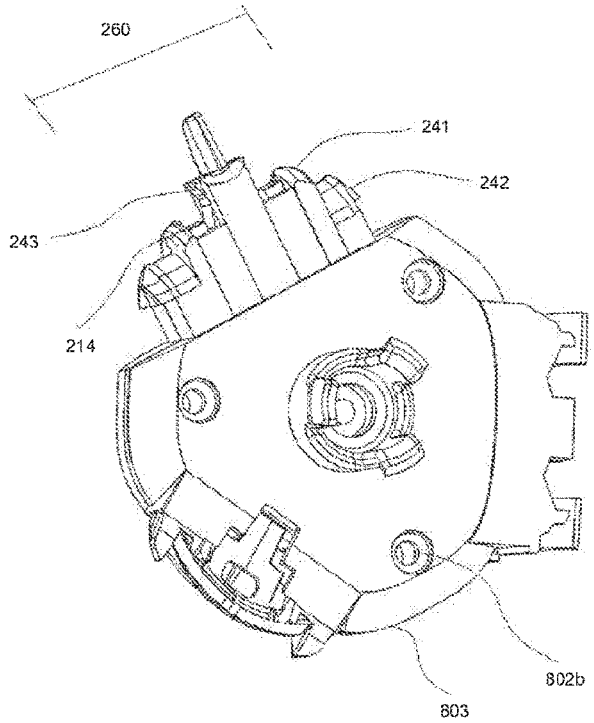
Figure 10B:
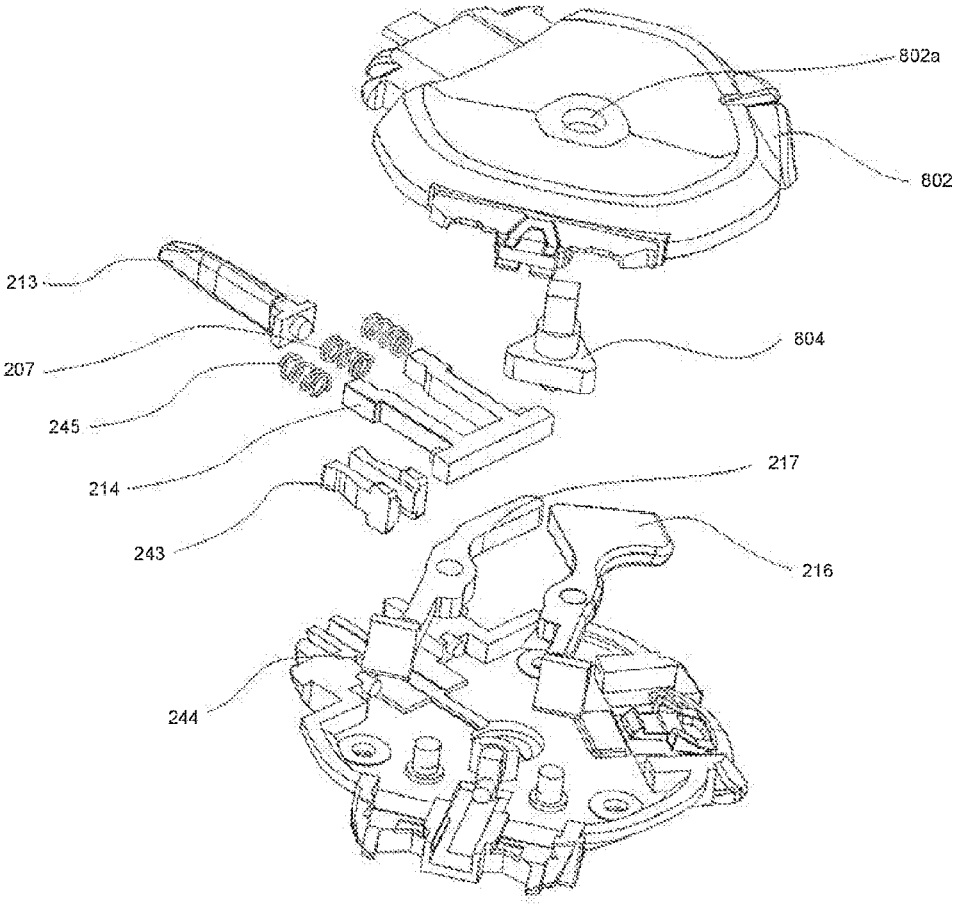
Figure 10C:
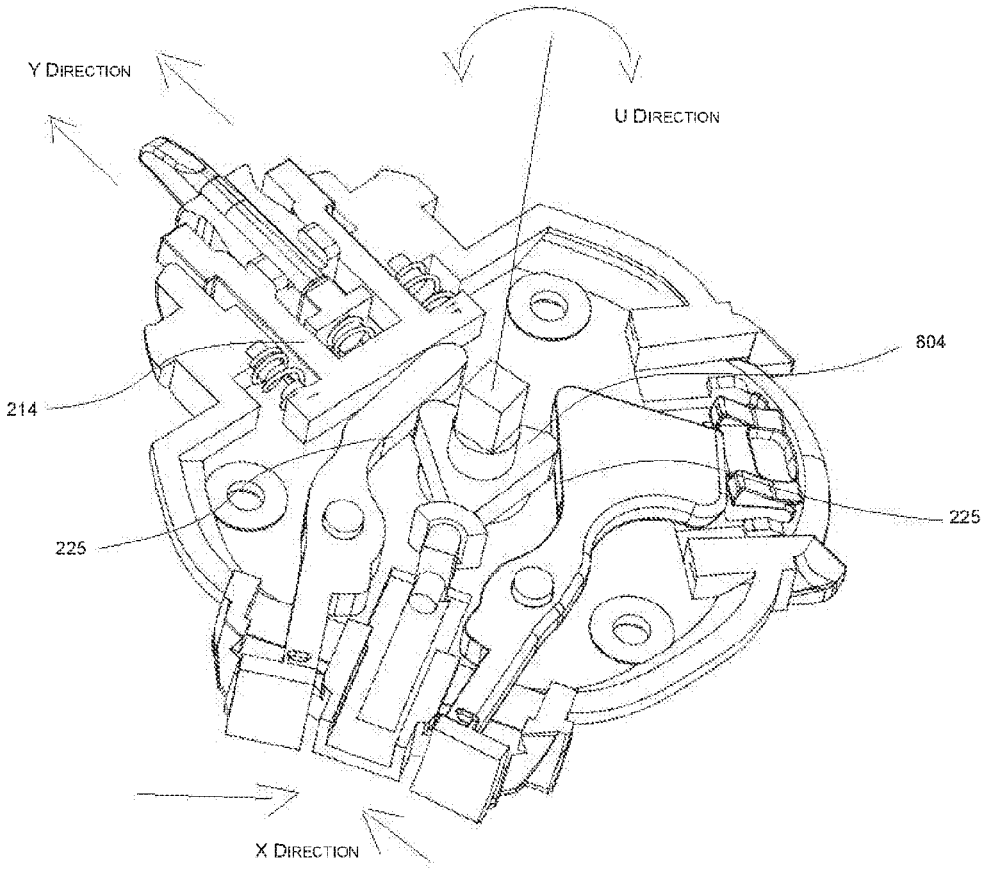

FIGS. 10A, 10B, and 10C illustrate exemplary isometric view, exploded view and working of blade holder and ejection system in accordance with an embodiment of the present disclosure. In an aspect, the triangular blade holder adaptor 800 as shown in FIG. 10A includes a top lid 802, a bottom lid 803, a plunger 213, and blade ejecting arm 214, wherein the plunger 213 and the blade ejecting arm 214 can be sandwiched between top lid 802 and the bottom lid 803 using locking screws 802*b*. In an aspect, on the second blade holder portion 260 of the proposed triangular blade holder adaptor 800, a vertical support ribs 241 and a horizontal support ribs 242 are provided for giving support and location to the shaving blade. Outer surface of the support ribs 241 & 242 are identical to the inner surface of shaving blade that fits on the second blade holder portion 260.

FIG. 10B illustrates an exploded view of the triangular blade holder adaptor 800 where two individual blade locking snaps 243 are fixed between the top lid 802 and the bottom lid 803 at the second blade holder portion 260 in the cut out 244 made in bottom lid 803 and having a concave surface on side for locking the shaving blade. The blade ejecting arm 214 has two parallel legs connected with each other by a horizontal support and are placed at the second blade holder portion 260. The blade ejecting arm 214 is in contact with the blade lock 217 from back side. The blade ejecting arm 214 is connected with spring 245 for ejecting shaving blade from the blade holder. In an aspect, arrangement of the rotary cam 804 and the triangular rotating knob (not shown here) can remain same as in FIGS. 8 and 9 to eject blades in different portions by a single action of the ejection system. The blade locks 216 and 217 can be pivotally joined with bottom lid 803 through a hinge pin, for instance.

FIG. 10C illustrates working of yet another embodiment of the blade holder adapter and the blade ejection system, where all blades can be ejected using cam follower mechanism. In an aspect, the proposed triangular blade holder adaptor 800 can include a triangular rotary cam 804 and follower mechanism to operate blade ejection system for three different kind of blades, wherein follower faces 225 can be continuously in contact with cam 804 by a flat metal spring 209. The cam 804 can be coupled to the triangular knob 801 so that the cam 804 can be manually operated through the triangular knob 801.

For unlocking the blade from second blade holder portion 260, triangular cam 804 can be rotated in U direction, and can move the blade locks 216 and 217 in outward direction. The blade lock 217 pushes the blade ejecting arm 214 in Y Direction, wherein two parallel legs of the ejecting arm push the locked portion of the shaving blade in Y direction, which was fixed in concave surface of snaps 243.

Figure 10D:
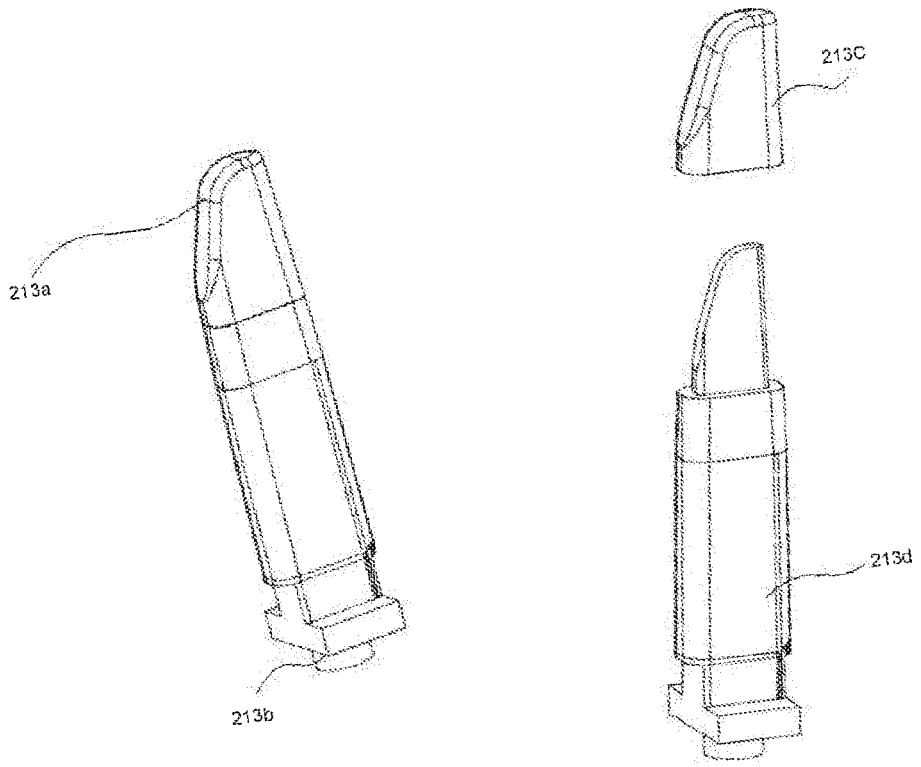

FIG. 10D illustrates an exemplary assembly of plunger 213 that is used for giving support to the shaving blade from back side and provide flexibility for easy adjustment to the shaving blade during shaving, wherein the plunger 213 has a top portion 213*c* (which can be made from rubber material) and has a flat surface 213*a* for continuous contact with back side of shaving blade. Bottom portions 213 *d* can be made from metal or plastic and can have a circular boss 213 *b* such that one end of the plunger spring 207 can be fit on the circular boss 213 *b* and another end can be in contact with blade ejecting arm 214.

Figure 11A:
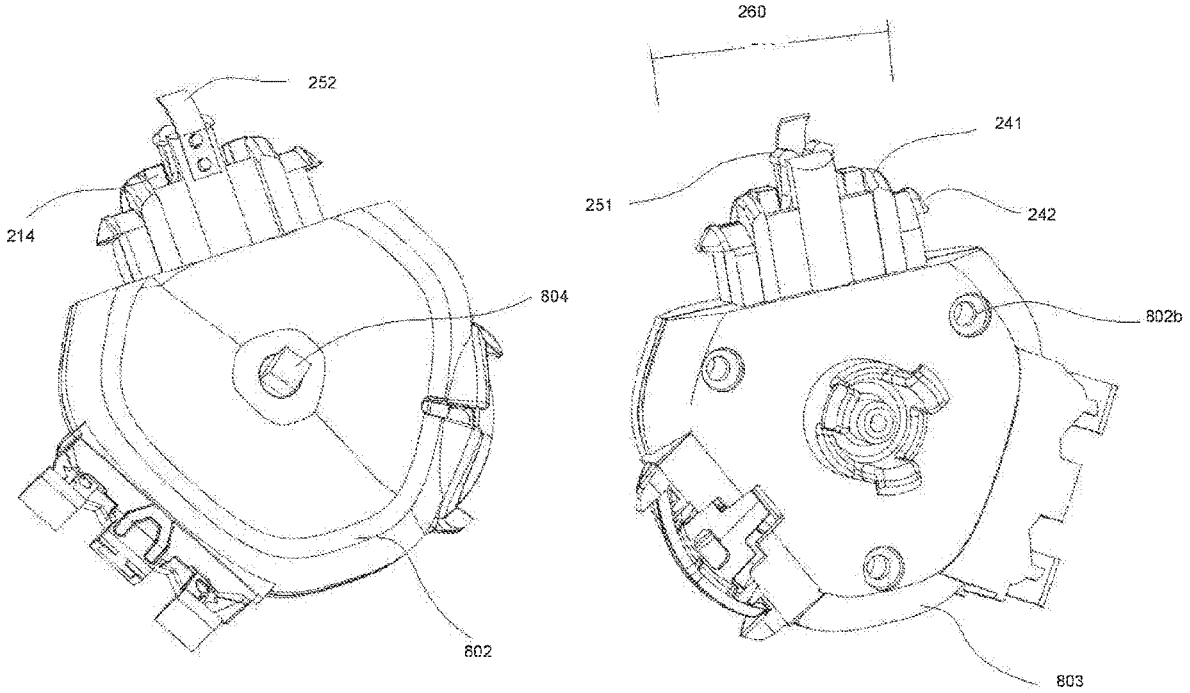
FIGS. 11A to 11C illustrate different exemplary views of a second triangular blade holder concept, in accordance with embodiments of the present disclosure.
Figure 11B:
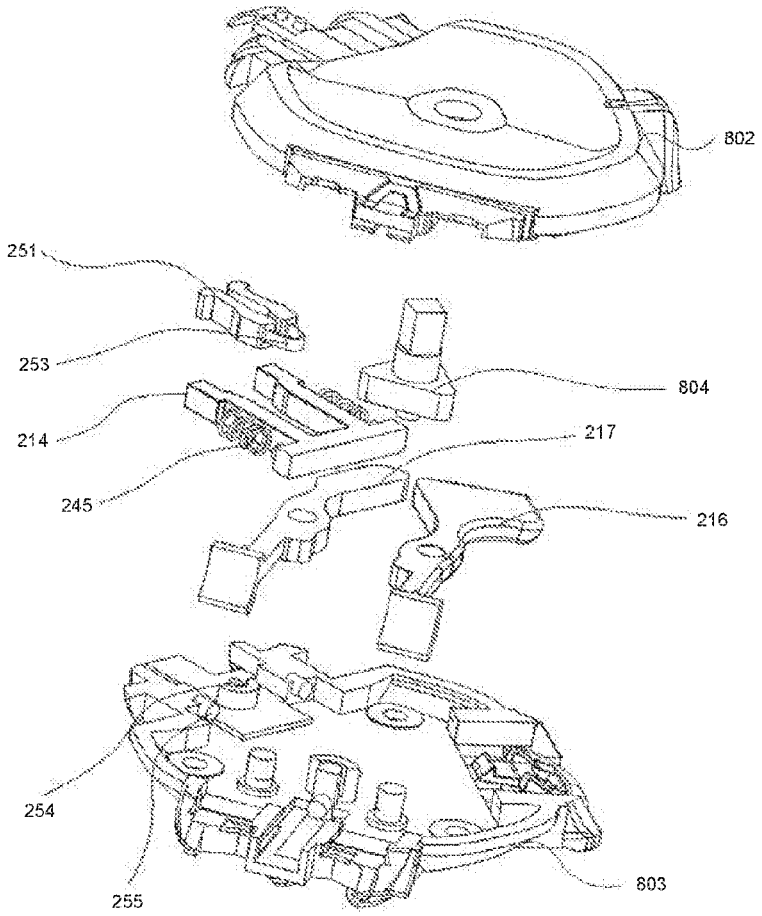
Figure 11C:
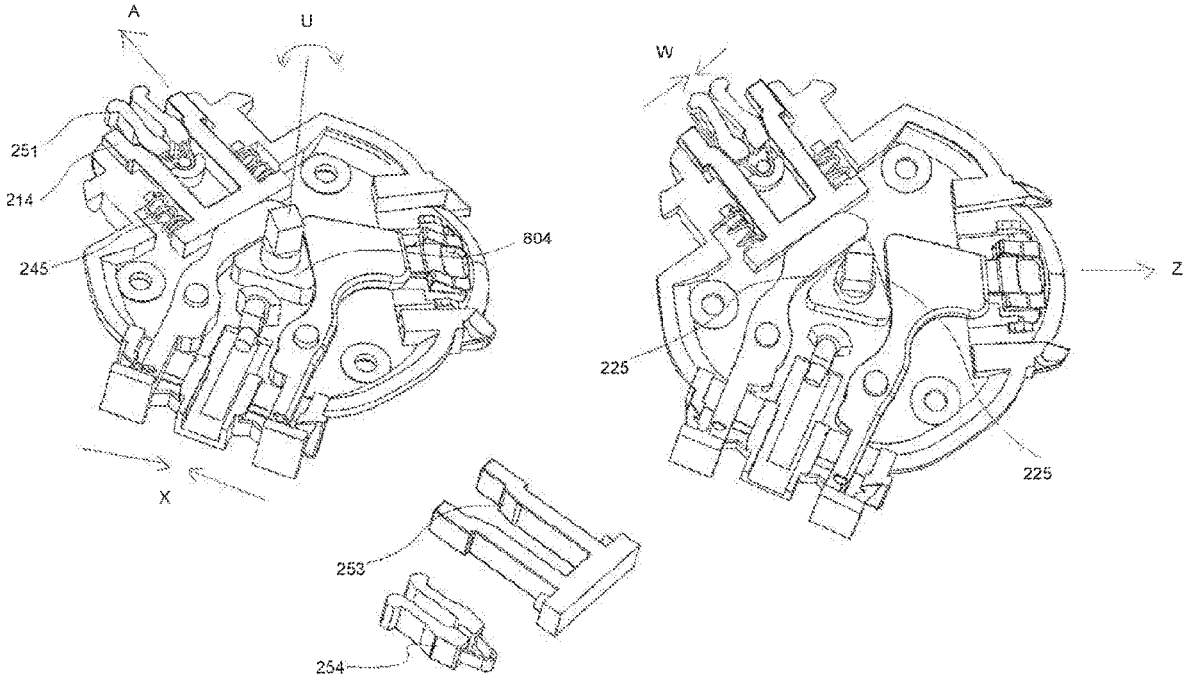

FIGS. 11A, 11B & 11C illustrate exemplary isometric and, exploded views showing working of the blade holder adaptor and its ejection system. In an aspect, triangular blade holder adaptor 800 as shown in FIG. 11A includes a top lid 802, a bottom lid 803, a triangular rotating knob 804, a leaf spring 252, a locking snap 251, and a blade ejecting arm 214, wherein blade ejecting pusher arm 214 and locking snap 251 can be sandwiched between the top lid 802 and the bottom lid 803 using locking screws 802*b* at second blade holding portion. On second blade holder portion of the triangular blade holder, vertical support ribs 241 and horizontal support ribs 242 can be provided for giving the support and location to the shaving blade. Half portion of support ribs can be provided on top lid 802 and another half portion of support ribs can be provided on the bottom lid 803. Outer surface of support ribs can be identical to the inner surface of shaving blade, which can be fitted on the second blade holder portion. Curved leaf spring 252 can be fixed on the top lid 802 at second blade holding portion, which gives support to the shaving blade from back side & provide flexibility for easy adjustment of the shaving blade during shaving. Leaf spring 252 can be made from metal or a plastic and fix with the top lid using fasteners or glue.

In an aspect, one end of the pusher arm springs 245 can be fixed on circular boss 255, and another end can be in contact with the blade ejecting pusher arms 214, which helps pusher arms to move back in its original position after ejection of the blade from second blade holding portion. Locking snap 251 can have two different parts that can be connected with each other using V shape metal leaf spring. Leaf spring 253 along with locking snap can be concentrically fixed with the circular boss 254. Locking snap 251 can include an external taper face 254 that can be continuously in contact with internal taper faces 253 of pusher arm 214. Circular boss 254 can act as a pivot point for the leaf spring 253. Blade ejecting arm 214 can have two parallel legs that are connected with each other by a horizontal support and placed at the second blade holder portion. Blade ejecting arm 214 is in contact with blade lock 217 from back side.

FIG. 11C illustrates exemplary working of blade holder and blade ejection system where all blades can eject using the proposed cam follower mechanism. In an aspect, the proposed triangular blade holder adaptor 800 can include a triangular rotary cam 804 and a follower mechanism to operate blade ejection system for three different kind of blades, wherein follower faces 225 can continuously be in contact with cam 804 by a flat metal spring 209 Cam 804 can be fixed with triangular knob 801 and cam 804 can be manually operated through it.

For unlocking the blade from the second blade holder portion, triangular cam can be rotated in U direction, and move blade lock 216/217 in outward direction. Blade lock 217 pushes the blade ejecting pusher arm 214 in A Direction, wherein two parallel legs of the ejecting arm can have an internal taper faces 253 that helps to push snap in W Direction. Inward movement of locking snap 251 helps to unlock the shaving blade and ejecting arm helps to push away the shaving blade from holder.

Figure 12A:
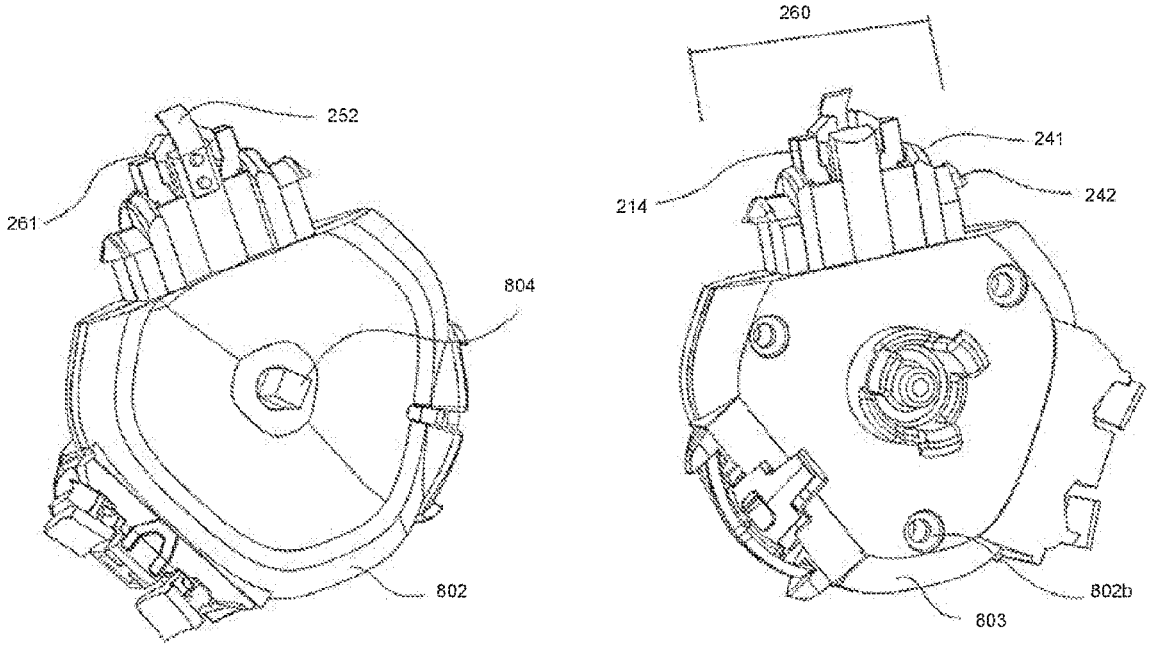
FIGS. 12A to 12C illustrate different exemplary views of a third triangular blade holder concept, in accordance with embodiments of the present disclosure.
Figure 12B:
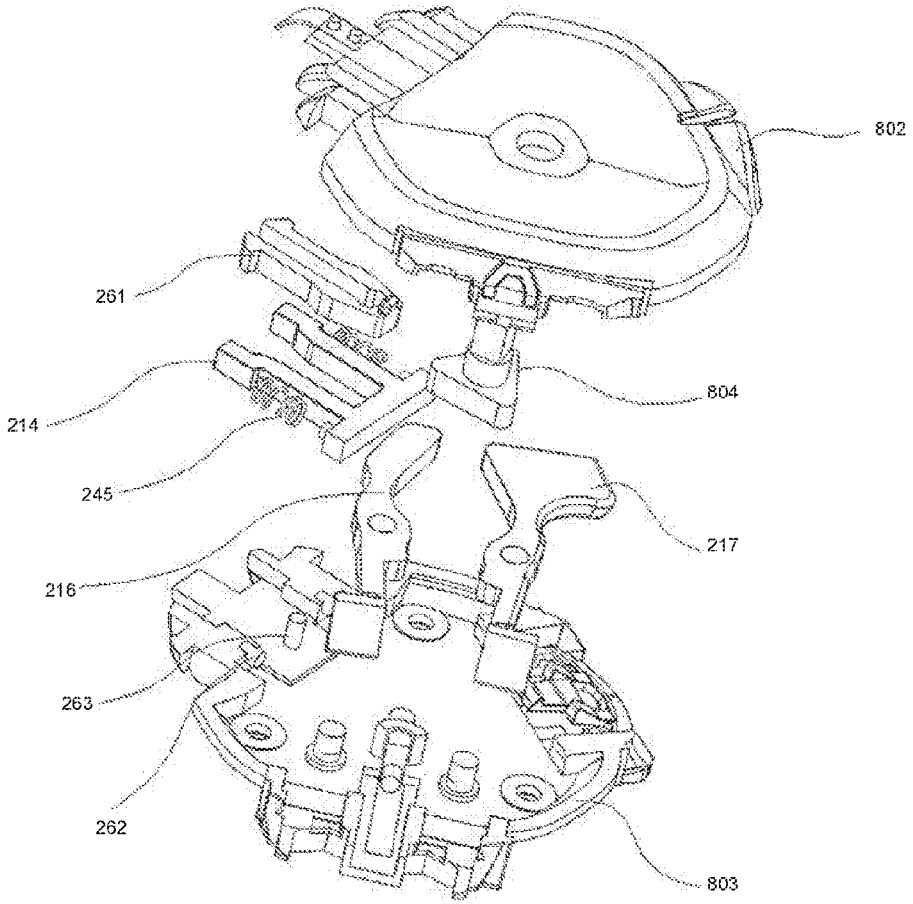
Figure 12C:
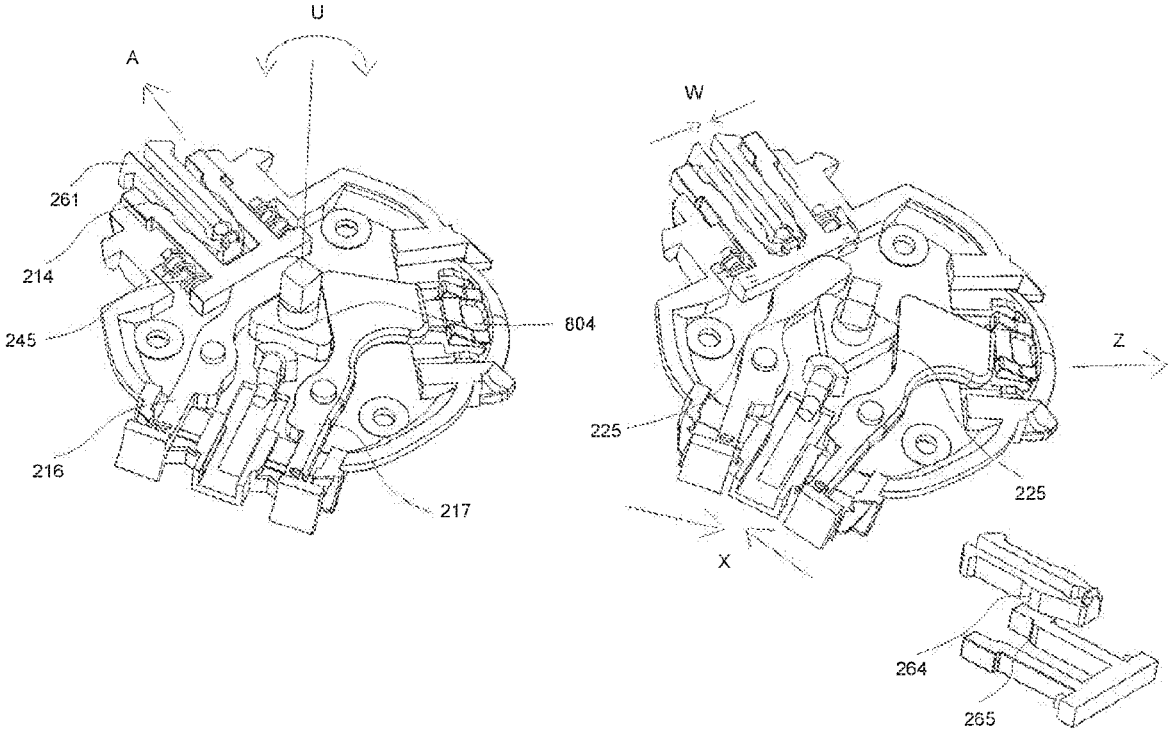

FIGS. 12A, 12B and 12C illustrate exemplary isometric view, exploded view and working of blade holder & ejection system. In an aspect, triangular blade holder adaptor 800 as shown in FIG. 12A includes a bottom lid, a top lid 802, a rotating knob 803, a blade locking snap 261, and a blade ejecting arm 214, where in the blade ejecting pusher arm 214 and the locking snap 261 can be sandwich between the top lid 802 and the bottom lid 803 using locking screws 802 *b* at second blade holding portion. On second blade holder portion of triangular blade holder, vertical support ribs 241 and horizontal support rib 242 can be provided for giving the supports and location to the shaving blade. Half portion of support ribs can be configured on top lid 802, and another half portion of support ribs can be configured on bottom lid 803. Outer surface of support ribs can be identical to the inner surface of shaving blade, which can fit on the second blade holder portion. Curved leaf spring 252 can be an integral part of the top lid 802 at second blade holding portion, which gives support to the shaving blade from backside and provides flexibility for easy adjustment of the shaving blade during shaving.

One end of pusher arm springs 245 can be fix on the circular boss 262 and another end can be in touch with blade ejecting pusher arms 214, which can help pusher arms to move back its in original position after ejection of the blade from second blade holding portion. Blade locking snap 261 can be a single piece plastic part having a smaller cross-sectional area at the bottom side (which act as a live hinge). Snap 261 can be fixed between top lid and bottom lid and can be located by snap pivot boss. Locking snap can include an external taper face 264 that can be continuously in contact with internal taper faces 265 of the pusher arm 214. Bottom portion of snap 261 can act as a live hinge by taking support of snap pivot boss 263. Blade ejecting arm 214 can have two parallel legs that can be connected with each other by a horizontal support and can be placed at the second blade holder portion. Blade ejecting arm 214 can be in contact with blade lock 217 from back side.

FIG. 12C illustrates working of blade holder and blade ejection system wherein all blades can be ejected using cam follower mechanism. Triangular blade holder adaptor 800 can include a triangular rotary cam 804 and follower mechanism to operate blade ejection system for three different kind of blades, wherein follower faces 225 can be continuously in contact with cam 804 by a flat metal spring 209. Cam 804 can be fixed with triangular knob 801 and cam 804 can be manually operated through it.

For unlocking the blade from the second blade holder portion, triangular cam can be rotated in Z direction, and can move blade locks 217 in outward direction. Blade lock 217 pushes the blade ejecting pusher arm 214 in A Direction. In an aspect, two parallel legs of ejecting arm can have an internal taper face 265 that helps to push snap in W Direction. Inward movement of the locking snap 261 can help unlock shaving blade, whereas linear movement of ejecting arm helps to push away the shaving blade from holder.

Figure 13A:
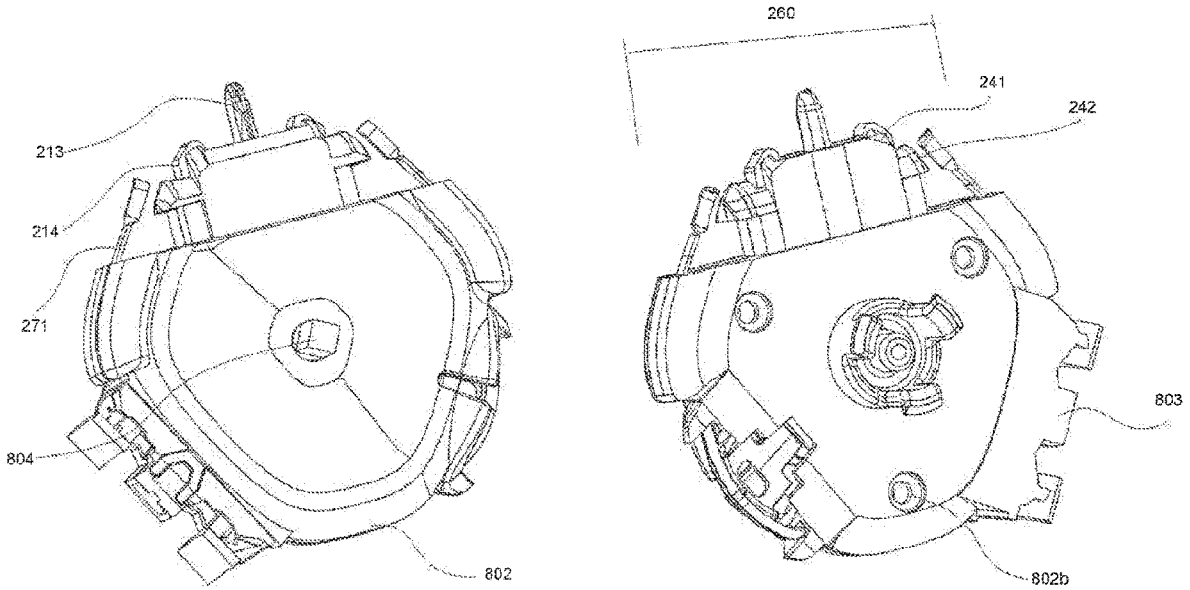
FIGS. 13A to 13C illustrate different exemplary views of a fourth triangular blade holder concept, in accordance with embodiments of the present disclosure.
Figure 13B:
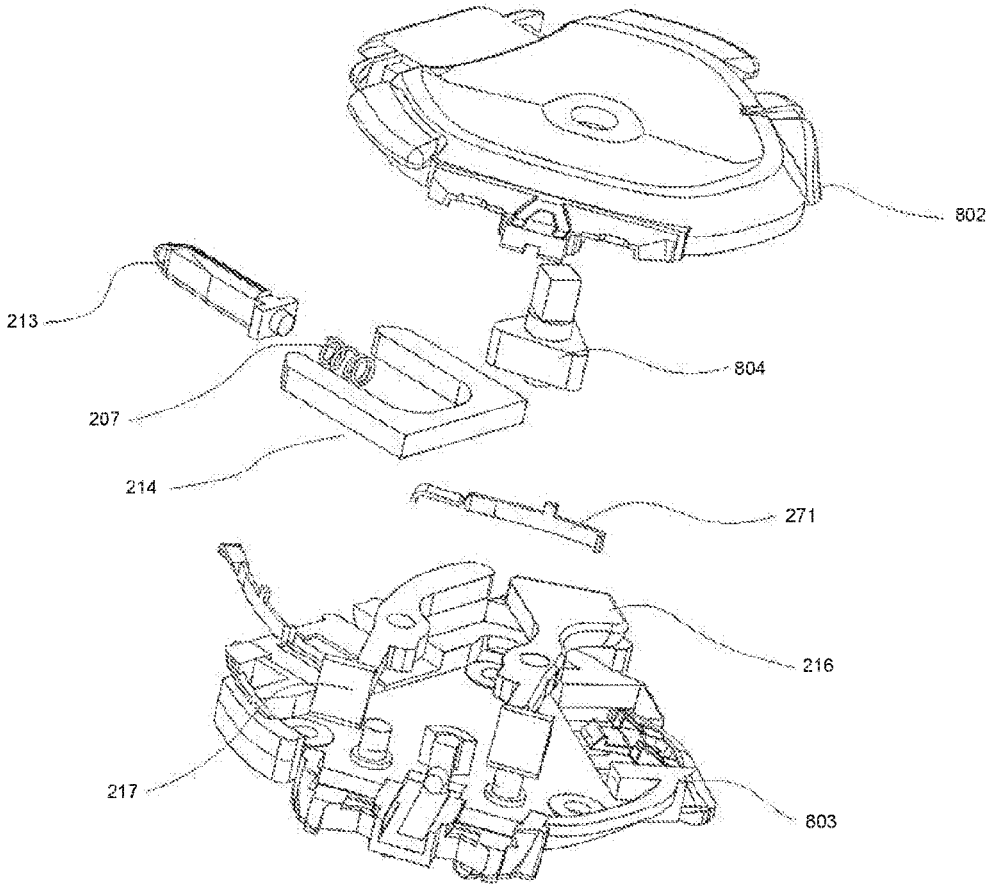
Figure 13C:
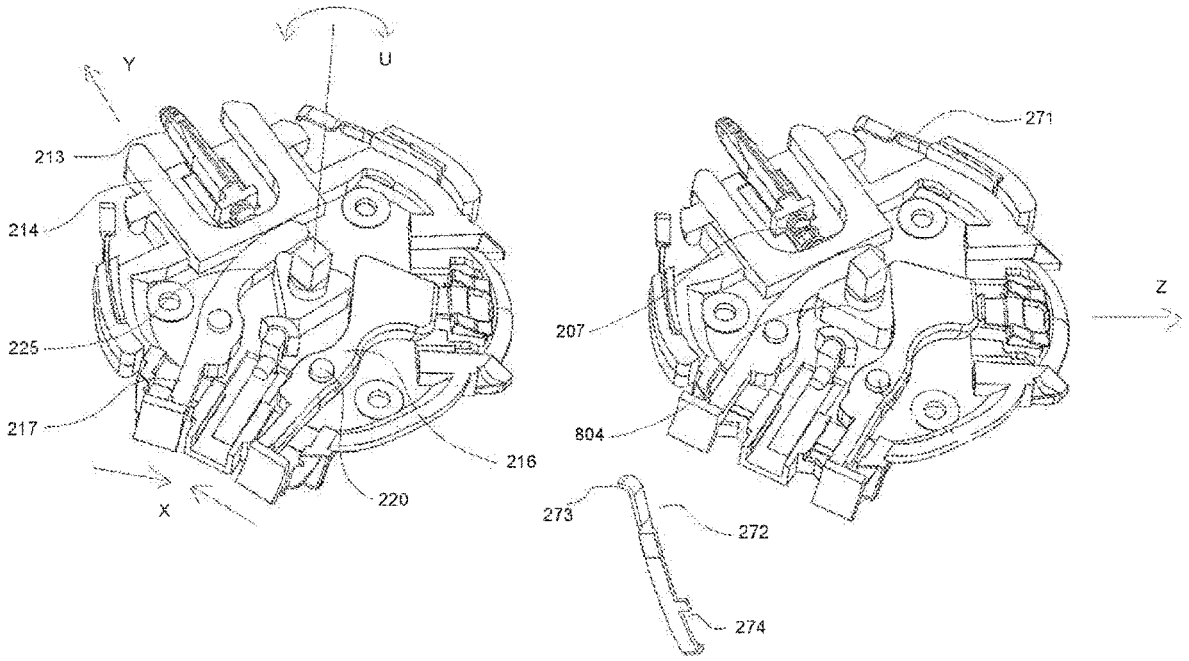

FIGS. 13A, 13B, and 13C illustrate exemplary isometric view, exploded view and working of blade holder and ejection system. In an aspect, triangular blade holder adaptor 800 as shown in FIG. 13A includes a bottom lid 803, a top lid 802, a rotating knob 804, a blade locking snap 271, and a blade ejecting arm 214, wherein the blade ejecting pusher arm 214 and the locking snap 271 can be sandwiched between the top lid 802 and the bottom lid 803 using locking screws 802*b* at second blade holding portion. Shaving blade locking snaps 271 can include two twisted metal strips that fix in the two sides of the second blade holding portion of the proposed triangular blade holder. Locking snaps 271 can also be configured as curved metal strips having a top body 272, a bottom body 274, and a locking bend 273. Top body can be twisted 90 degrees with reference to bottom body for changing orientation of locking face, and locking bend 273 can be a bend part of top body 272 for locking the blade in second blade holding portion. Bottom body 274 can be permanently fixed inside the grooves made in bottom lid. On second blade holder portion of triangular blade holder, vertical support ribs 241 and horizontal support rib 242 can be provided for giving the support and location to the shaving blade. Half portion of support ribs can be configured on top lid 802, and another half portion of support ribs can be configured on bottom lid 803. Outer surface of support ribs can be identical to the inner surface of shaving blade that is fitted on the second blade holder portion.

Spring loaded plunger 214 can be used for giving support to the shaving blade from back side, provide flexibility for easy adjustment to the shaving blade during shaving.

For unlocking the blade from second blade holder portion, triangular cam can be rotated in Y direction, which moves blade locks 217 and 216 in outward direction. Blade lock 217 can push the blade ejecting arm 214 in Y Direction. Two parallel legs of ejecting arm can push the shaving blade in Y direction, which removes the blade from blade locking snap 271.

Figure 14A:
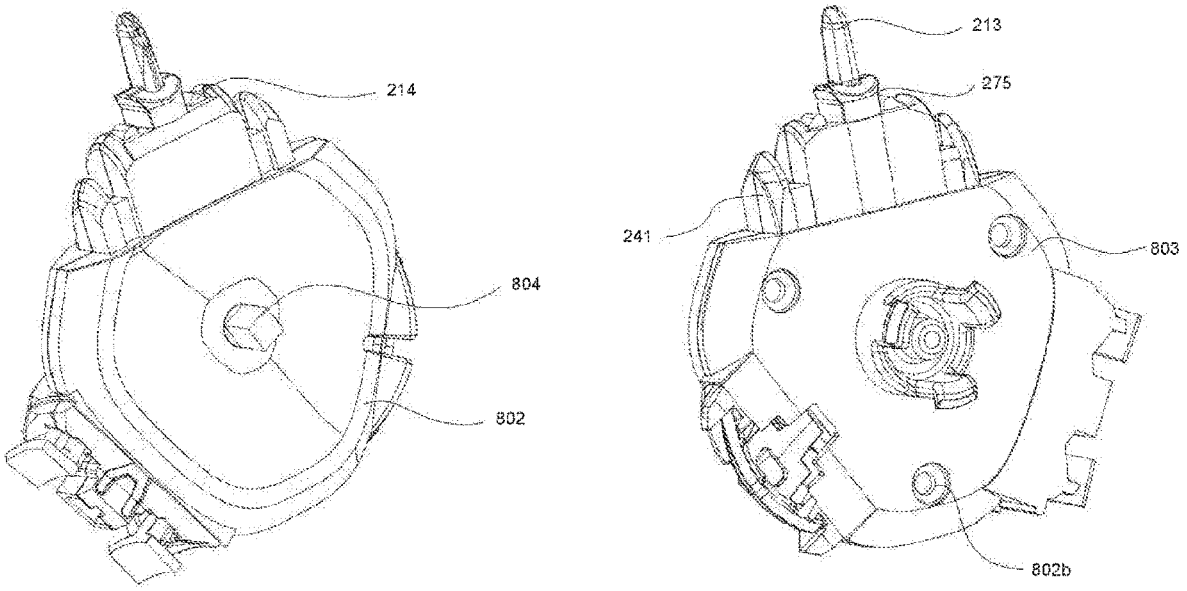
FIGS. 14 A to 14C illustrate different exemplary views of a fifth triangular blade holder concept, in accordance with embodiments of the present disclosure.
Figure 14B:
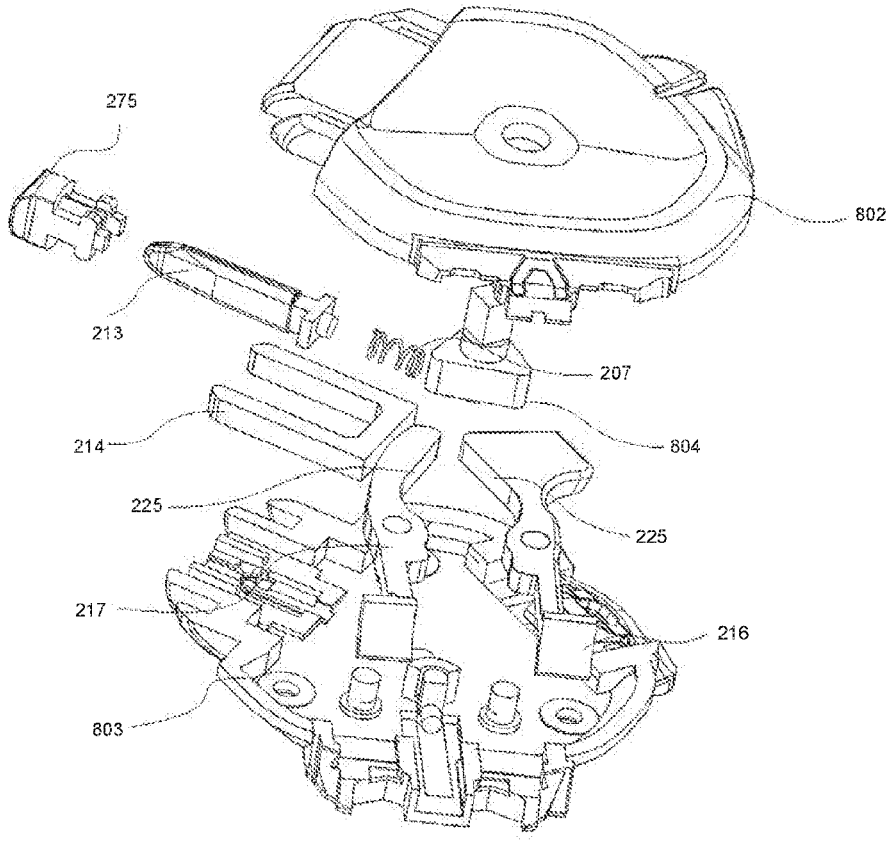
Figure 14C:
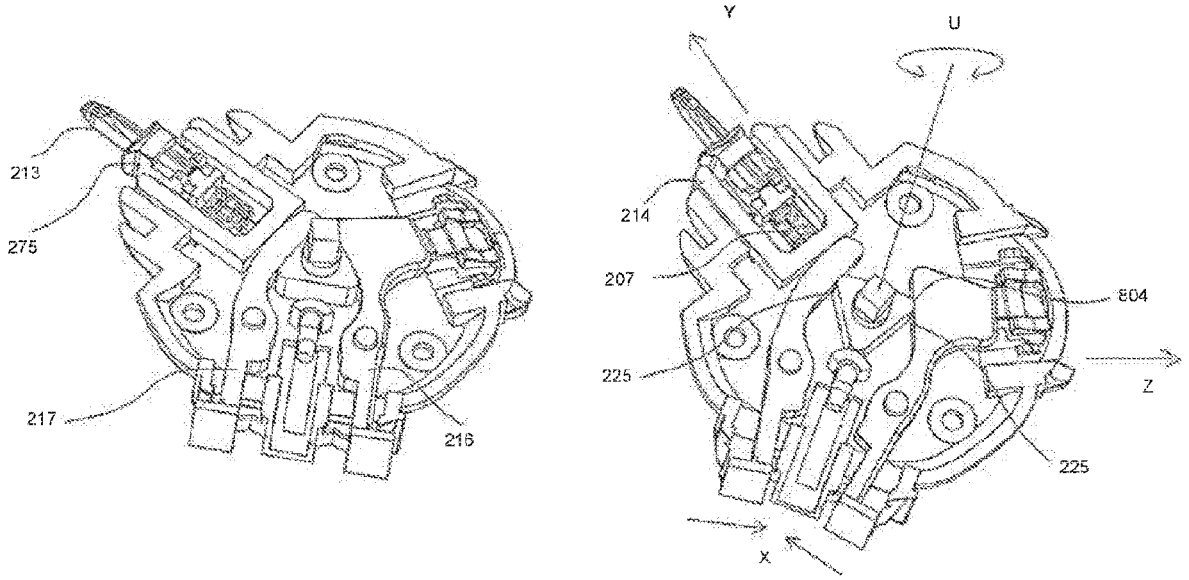

FIGS. 14A, 14B, and 14C illustrate exemplary isometric view, exploded view and working of blade holder & ejection system. In an aspect, triangular blade holder adaptor 800 is shown in FIG. 14A and can include a bottom lid 803, a top lid 802, a rotating knob 804, a plunger 214, a blade locking snap, and a blade ejecting arm 214, wherein the blade ejecting pusher arm 214, the plunger 213, and the locking snap 275 can be sandwich between the top lid 802 and the bottom lid 803 using locking screws 802*b* at second blade holding portion. Locking snap 275 can be a hollow part having a concave surface on two side for locking the shaving blade. Spring loaded plunger 213 can be guided in the hollow portion of locking snap, which can be used for giving support to the shaving blade from back side & provide flexibility for easy adjustment to the shaving blade during shaving.

On second blade holder portion of triangular blade holder, support ribs 241 can be provided for giving support and location to the shaving blade. Half portion of support ribs can be configured on top lid 802, and another half portion of support ribs can be configured on bottom lid 803. Outer surface of support ribs can be identical to the inner surface of shaving blade that is fitted on the second blade holder portion. For unlocking the blade from the second blade holder portion, triangular cam can be rotated in U direction and moves blade locks 217 and 216 in outward direction. Blade lock 217 pushes the blade ejecting arm 214 in Y Direction. Two parallel legs of ejecting arm push the shaving blade in Y direction which removes the blade from blade locking snap 275.

Figure 15A:
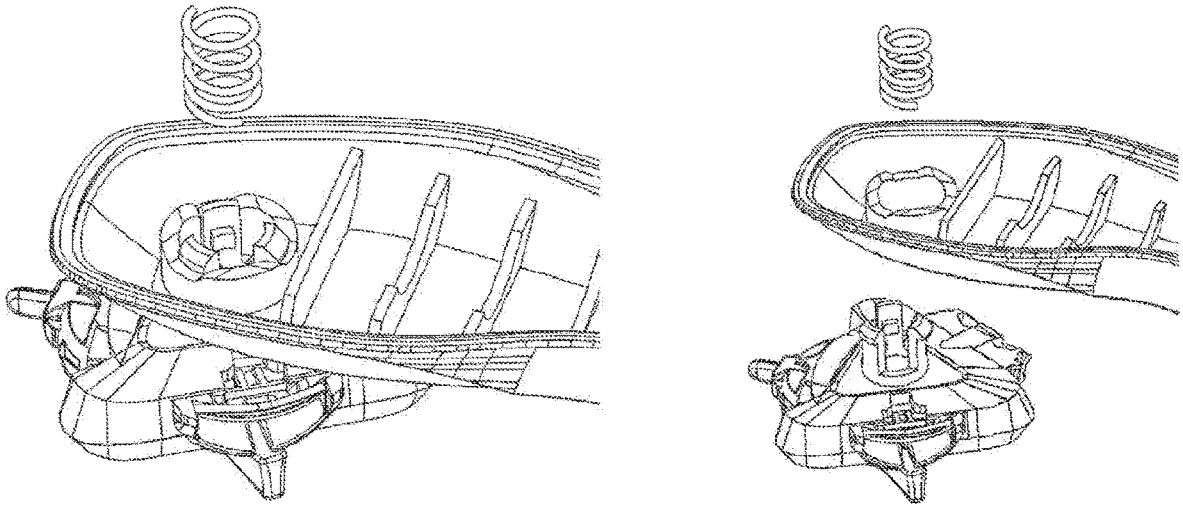
FIGS. 15A and 15B illustrate exemplary representation of assembly and working of blade holder assembly with top cover, in accordance with embodiments of the present disclosure.

FIG. 15A illustrates an exemplary representation of blade holder adaptor 800 with top cover 701 wherein a snaps 803*c* are pressed in the circular cutout 708 for fixing blade holder adaptor 800 in the top cover 701. A snap locking boss 1001 includes three snap resting faces 1002 for resting the snaps 803*c*, wherein each snap resting face has two flanking side faces, one on either side, such as a first side face 1003 and a second side face 1004, for controlling rotational movement of snaps 803*c* after the snaps have been located on the respective snap resting faces 1002. The snap locking hollow boss 1001 is an integral part of top cover 710. The blade holder spring 705 rests on three spring resting boss 803*d*.

Figure 15B:
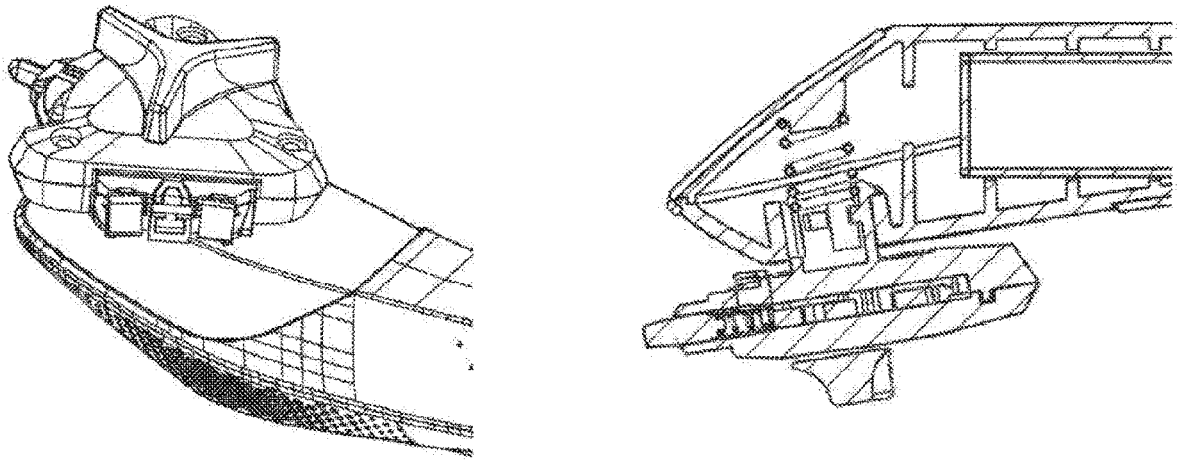

FIG. 15B illustrates assembly of the blade holder adaptor 800 with the top cover 701, wherein the blade holder adaptor 800 is continuously forced towards the top cover 701 by action of the blade holder spring 705 after assembly, and due to which gap 1005 between blade holder adaptor 800 and top cover 701 remains constant.

In an aspect, if user wants to rotate blade holder adaptor 800 for using different kind of blades fixed with the first blade holder portion 250, the second blade holder portion 260 or the third blade holder portion 270, he must push blade holder in "P" direction. As user pushes the blade holder adaptor 800 in "P" direction, the blade holder spring 705 is compressed and snap 803*c* is free from first side face 1003 and second side face 1004, so user can rotate blade holder adaptor 800 in"V" direction till the desired blade comes in position of use.

It is to be appreciated that arrangement of snaps as shown in FIGS. 15A and 15B can also be used when the blade holder adaptor other than triangular shaped, for example polygon shaped, with a difference that number of snaps such as snap 803*c*, can be same as number of sides in the polygon shaped blade holder adaptor. Similarly number of resting faces such as resting faces 1002, can also be equal to the number of sides in the polygon shaped blade holder adaptor. As can be appreciated by those skilled in the art, the arrangement can provide a satisfactory attachment means for detachably attaching the blade holder adaptor to the top enclosure, and can enable the blade holder adaptor to be oriented on the top enclosure with any one of the plurality of blade holder portions in position of use.

Figure 16A:
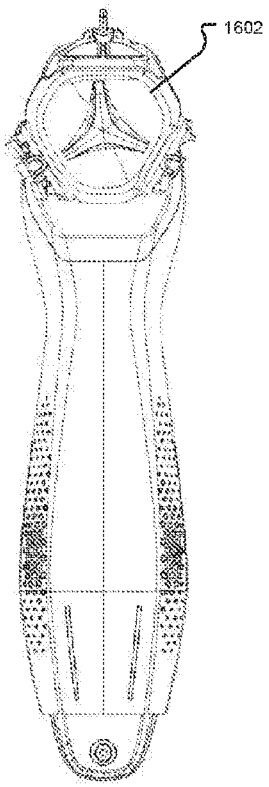
FIG. 16 illustrates an exemplary representation of the proposed multifunctional razor with other than triangular shaped blade holder adaptor, in accordance with embodiments of the present disclosure.
Figure 16B:
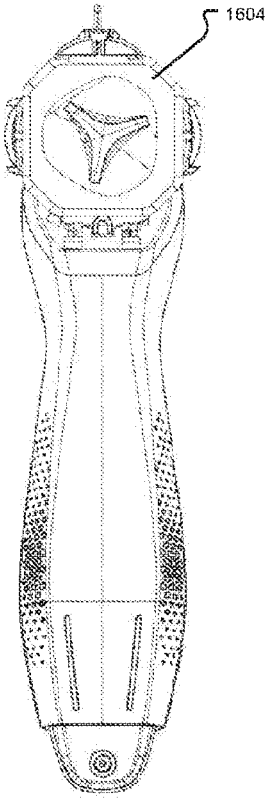
Figure 16C:
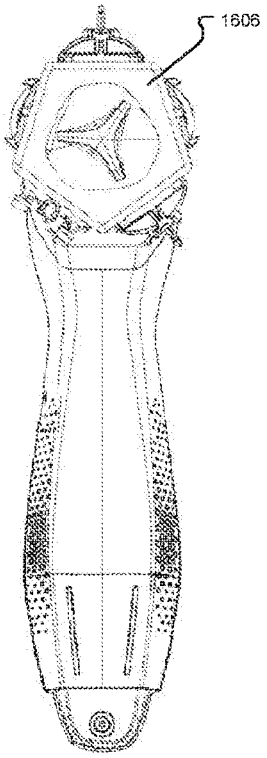

FIGS. 16A to 16C illustrate exemplary representation of the proposed multifunctional razor with other than triangular shaped blade holder adaptors, in accordance with embodiments of the present disclosure. As shown in FIGS. 16A and 16C the blade holder adaptors 1602 and 1606 can be pentagonal shape with five blade holder portions, or as shown in FIG. 16B the blade holder adaptor 1606 can be square shaped with four blade holder portions. As explained above arrangement of snaps 803*c* and resting faces 1002 can be used as attachment means for detachably attaching the blade holder adaptors 1602/1604/1606 to the top enclosure/razor body, and can enable the blade holder adaptor 1602/1604/1606 to be oriented on the top enclosure/razor body with any one of the plurality of blade holder portions in position of use.

In an embodiment, the multifunctional razor of the present disclosure can be configured for shaving head of a person by incorporating a wheel on the bottom cover 821 (refer to FIG. 6B), the wheel can be rested on the head of the person being shaved to provide a support to the razor behind the blade. As the razor is moved, the wheel follows the contour of the head to make the blade to follow the same contour.

Figure 17:
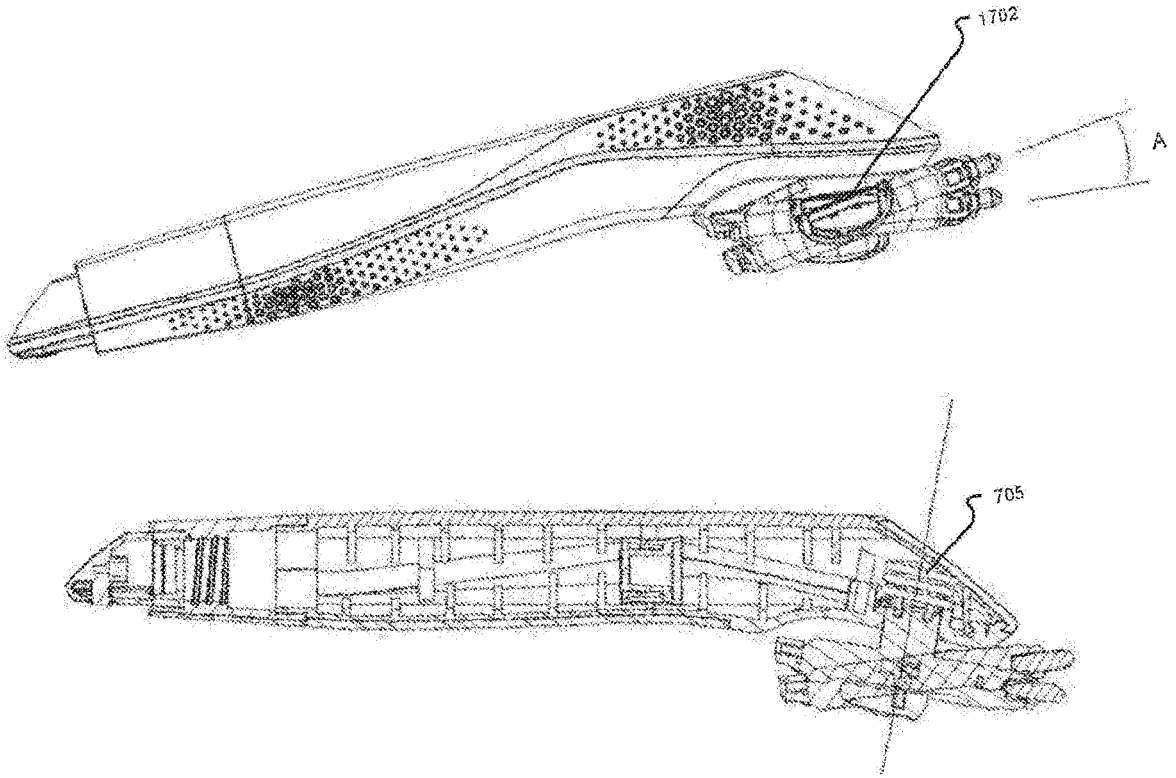
FIG. 17 illustrates an exemplary representation of the proposed multifunctional razor with a flexible joint between the razor body and the bladed holder adaptor, in accordance with embodiments of the present disclosure.

In yet another embodiment, the blade holder adaptor can be held on the razor body through a flexible joint that allows the blade holder to tilt relative to the razor body. This can be achieved by introducing a rubber sheet 1702 between the razor body and the blade holder adaptor, which would allow the blade holder adaptor to tilt by angle A as shown in FIG. 17.

While embodiments of the present disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims.

Advantages of the Invention

The present disclosure provides a universal shaving razor that accommodates more than one kind of blade cartridge.

The present disclosure provides a universal shaving razor that accommodates shaving gel, after shave and trimmer in its body.

The present disclosure provides a single wet shaving razor that can be used for shaving as well as trimming.

The present disclosure provides a compact and low cost multifunctional wet shaving razor.

We claim:

1. A multifunctional razor comprising:

a razor body having a top enclosure and a bottom enclosure; and a blade holder adaptor detachably attached to the top enclosure and having a triangular shape, wherein three sides of the triangular shaped blade holder adaptor define three blade holder portions, each of the three blade holder portions adapted to hold a different kind of blade cartridge, wherein the three blade holder portions comprise:

a first blade holder portion that is adapted to hold and eject a shaving blade cartridge that is held and locked by a plastic snap;

a second blade holder portion that is adapted to hold and eject a shaving blade cartridge that is held and locked by clips and support collar; and a third blade holder portion that is adapted to hold and eject a shaving blade cartridge that is held and locked by leaf spring, plunger and pusher arms;

wherein an attachment means for detachably attaching the blade holder adaptor to the top enclosure enable the blade holder adaptor to be fitted on the top enclosure with anyone of the three blade holder portions in position of use.

2. The multifunctional razor as claimed in claim 1, wherein the attachment means comprises:

three pins provided on the blade holder adaptor, the three pins being in equilateral triangle configuration and positioned in symmetry with the three portions of the blade holder adaptor, and a pair of parallel grooves comprising a front groove and a rear groove, provided on the top enclosure;

wherein when the blade holder adaptor is to be attached with the top enclosure with a desired blade holder portion in position of use, two of the three pins that are nearer to the desired blade holder portion of the blade holder adaptor are engaged with the front groove, and the third pin is engaged with the rear groove.

3. The multifunctional razor as claimed in claim 2, wherein the front groove and the rear groove are T shaped with the three pins having a corresponding shape.

4. The multifunctional razor as claimed in claim 1, wherein the attachment means comprises;

three equispaced snaps arranged in circular configuration on back side of the blade holder adaptor;

a circular cutout provided in a top cover of the multifunctional razor, lower side of the circular cutout incorporating a snap locking hollow boss, the snap locking hollow boss incorporating three equispaced snap resting faces for resting the three equispaced snaps, wherein both sides each of the three snap resting faces is flanked by a flanking side face to prevent rotational movement of the blade holder adaptor; and a spring configured between the top cover and the blade holder adapter to bias the snaps against the respective snap resting faces;

wherein when a different blade holder portion is to be used, the blade holder adaptor is pushed down against the biasing force of the spring to move the snaps beyond the respective flanking side faces, and thereafter rotated till the desired blade holder portion is in position of use, and thereafter the blade holder adaptor is released for the snaps to take seat against the snap resting faces.

5. The multifunctional razor as claimed in claim 1, wherein the bottom enclosure is adapted to hold a shaving gel dispenser.

6. The multifunctional razor as claimed in claim 5, wherein the shaving gel dispenser comprises:

a gel container having a threaded top side, and adapted to be housed within the top enclosure such that the threaded top side of the gel container projects out of the top enclosure;

a gel dispensing cap guided inside the bottom enclosure and adapted to move linearly against biasing force of a spring; and a gel dispensing pump fitted between the gel dispensing cap and the threaded top side from inner side of the threaded top side;

wherein the threaded top side of the gel container is fitted in an internal threads of the bottom enclosure, and the bottom enclosure is thereafter fitted to the top enclosure with the gel container inserted within the top enclosure.

7. A blade holder adaptor configured to be detachably attached to a razor body; the blade holder adaptor having a triangular shape, wherein three sides of the triangular shaped blade holder adaptor define three portions: a first blade holder portion, a second blade holder portion and a third blade holder portion;

wherein each of the three blade holder portions is adapted to hold a different kind of blade cartridge, wherein the first blade holder portion is adapted to hold and eject a shaving blade cartridge that is held and locked by a plastic snap, wherein the second blade holder portion is adapted to hold and eject a shaving blade cartridge that is held and locked by clips and support collar, and wherein the third blade holder portion is adapted to hold and eject a shaving blade cartridge that is held and locked by leaf spring, plunger and pusher arms; and wherein the blade holder adaptor incorporates a single blade ejection system for unlocking respective blade cartridges held in any of the three blade holder portions.

8. The blade holder adaptor as claimed in claim 7, wherein the blade ejection system comprises:

a cam;

a first blade lock and a second blade lock, each pivotally fixed for pivotal movement through a respective hinge pin hole, the respective hinge pin hole dividing the first blade lock and a second blade lock between a front side portion and a rear side portion; the rear side portions incorporating a follower face; and the front side portions incorporating a first blade locking lip adapted to hold a blade cartridge of first type in the first blade holder portion;

wherein the first blade lock and the second blade lock are biased such that the respective follower face is in contact with the cam, and when the cam is moved, the first blade locking lips of the first blade lock, and the second blade lock of the second blade lock move inwards to release the blade cartridge held in the third blade holder portion.

9. The blade holder adaptor as claimed in claim 8, wherein the rear side portion of the first blade lock is adapted to, when the cam is moved, push a blade locking snap to eject a blade cartridge held in the first blade holder portion.

10. The blade holder adaptor as claimed in claim 9, wherein the bottom lid incorporates a pair of hinge pins to pivotally hold the first blade lock and the second blade lock.

11. The blade holder adaptor as claimed in claim 8, wherein the rear side portion of the second blade lock is adapted to, when the cam is moved, push a pusher arm to eject a blade cartridge held in the second blade holder portion.

12. The blade holder adaptor as claimed in claim 8, wherein the blade ejection system further includes a flat metal spring that pushes the front side portions of the first blade lock and the second blade lock to bias the first blade lock and the second blade lock for the respective follower faces to remain in contact with the cam.

13. The blade holder adaptor as claimed in claim 8, wherein the blade holder adaptor comprises a top lid and a bottom lid, and wherein the blade ejection system is accommodated between the top lid and the bottom lid.

14. The blade holder adaptor as claimed in claim 13, wherein the cam is adapted to move linearly against a biasing force of a spring.

15. The blade holder adaptor as claimed in claim 14, wherein the blade holder adaptor further comprises a slider button configured in a slider button guide in the top lid, and coupled to the cam for imparting the linear movement to the cam for ejecting the blade cartridges.

16. The blade holder adaptor as claimed in claim 13, wherein the cam is a rotary cam and the blade holder adaptor further comprises a triangular rotating knob on the top lid and coupled to the rotary cam for manual actuation of the rotary cam for ejecting the blade cartridges.

17. A multifunctional razor comprising:

a razor body having a top cover, a bottom cover;

a blade holder adaptor detachably attached to the bottom cover on a backside of the razor body, and having a triangular shape, wherein three sides of the triangular shaped blade holder adaptor define three blade holder portions, each of the three blade holder portions adapted to hold a different kind of blade cartridge, wherein the three blade holder portions comprise:

a first blade holder portion that is adapted to hold and eject a shaving blade cartridge that is held and locked by plastic snap;

a second blade holder portion that is adapted to hold and eject a shaving blade cartridge that is held and locked by clips and support collar; and a third blade holder portion that is adapted to hold and eject a shaving blade cartridge that is held and locked by leaf spring plunger and pusher arms;

wherein the multifunctional razor also incorporates a trimmer assembly along with a power source, the trimmer assembly and the power source housed between the top cover and the bottom cover and trimmer blades of the trimmer assembly located on a front side of the razor body being exposed through a window in an outer enclosure that fits the top cover and the bottom cover.

18. The multifunctional razor as claimed in claim 17, wherein the trimmer assembly comprises;

an electric motor to drive an eccentric shaft, an eccentric follower driven by the eccentric shaft to undergo reciprocating rotary motion;

a motion transfer link to transfer the reciprocating rotary motion of the eccentric follower to a first trimmer blade;

wherein reciprocating motion of the first trimmer blade in relation with a fixed second trimmer blade provides cutting action to trim hair.

19. The multifunctional razor as claimed in claim 17, wherein the multifunctional razor further comprises a front cover to cover the exposed trimmer blades of the trimmer assembly.

20. A multifunctional razor comprising:

a razor body having a top enclosure and a bottom enclosure; and a blade holder adaptor detachably attached to the top enclosure and having a polygon shape, wherein sides of the polygon shaped blade holder adaptor define a plurality of blade holder portions, each of the plurality of blade holder portions adapted to hold a different kind of blade cartridge, wherein the plurality of blade holder portions comprise:

a first blade holder portion that is adapted to hold and eject a shaving blade cartridge that is held and locked by a plastic snap;

a second blade holder portion that is adapted to hold and eject a shaving blade cartridge that is held and locked by clips and support collar; and a third blade holder portion that is adapted to hold and eject a shaving blade cartridge that is held and locked by leaf spring, plunger and pusher arms;

wherein an attachment means for detachably attaching the blade holder adaptor to the top enclosure enable the blade holder adaptor to be fitted on the top enclosure with anyone of the plurality of blade holder portions in position of use.

21. The multifunctional razor as claimed in claim 20, wherein the blade holder adaptor is of square shape, and four sides of the square shaped blade holder adaptor define four blade holder portions, each of the four blade holder portions adapted to hold a different kind of blade cartridge.

* * * * *